US006383537B1

(12) United States Patent
Brady et al.

(10) Patent No.: US 6,383,537 B1
(45) **Date of Patent: *May 7, 2002**

(54) PATCH BAG HAVING OVERHANGING BONDED PATCHES

(75) Inventors: Sean Allen Brady, Greer, SC (US); Richard Dee Reviere, Tryon, NC (US); Henry Walker Stockley, III, Spartanburg, SC (US)

(73) Assignee: Cryovac, Inc., Duncan, SC (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/193,918

(22) Filed: Nov. 17, 1998

Related U.S. Application Data

(63) Continuation of application No. 08/742,172, filed on Nov. 4, 1996, now abandoned, which is a continuation of application No. 08/268,087, filed on Jun. 28, 1994, now abandoned.

(51) Int. Cl.[7] ..... B32B 31/00

(52) U.S. Cl. ..... 426/129; 426/127; 426/415; 383/116; 383/119

(58) Field of Search ..... 426/124, 127, 426/129, 415; 383/109, 114, 116, 119

(56) References Cited

U.S. PATENT DOCUMENTS

| | | | | |
|---|---|---|---|---|
| 3,383,746 | A | 5/1968 | Narduzzi et al. | 29/33.5 |
| 3,454,441 | A | 7/1969 | Spruyt | 156/244 |
| 3,552,090 | A | 1/1971 | Roberts et al. | 53/71 |
| 3,628,576 | A | 12/1971 | Owen | 141/65 |
| 4,064,296 | A | 12/1977 | Bornstein et al. | 428/35 |

(List continued on next page.)

FOREIGN PATENT DOCUMENTS

| | | |
|---|---|---|
| DE | 1198731 | 8/1965 |
| EP | 0 151 489 | 8/1985 |
| EP | 0 512 740 | 11/1992 |
| EP | 0 562496 | 9/1993 |
| EP | 0 621 205 | 10/1994 |
| GB | 0 654 460 | 6/1951 |
| GB | 0 855317 | 11/1960 |
| GB | 0 925 035 | 5/1963 |
| GB | 1 250 101 | 10/1971 |
| GB | 2057392 | 8/1979 |
| GB | 2074128 | 10/1981 |
| GB | 2 291 402 | 1/1996 |
| NZ | 230362 | 9/1991 |
| NZ | 236317 | 9/1992 |
| NZ | 236523 | 4/1993 |
| WO | 90/03414 | 4/1990 |
| WO | 93/03093 | 10/1992 |

OTHER PUBLICATIONS

J. Poly. Sci. Poly. Phys. Ed., vol. 2, p. 441 (1982).

*Primary Examiner*—Gabrielle Brouillette
*Assistant Examiner*—Hao Mai
(74) *Attorney, Agent, or Firm*—Rupert B. Hurley Jr.

(57) ABSTRACT

One or more patches adhered to a bag have a first-patch-overhang-region and a second-patch-overhang-region, wherein at least a portion of said first-patch-overhang-region is adhered to said second-patch-overhang-region. The overhang regions are preferably present on separate patches adhered to the bag. The patches can extend completely around the bag, eliminating uncovered regions, thereby providing protection against puncture by a bone-in meat product packaged within the bag. This "full width patch bag" has been discovered to be particularly beneficial in reducing punctures in the packaging of whole bone-in pork loins. Other bag embodiments without patch overhangs are also disclosed, for solving the bone puncture problem by providing alternative full width patch bags.

24 Claims, 9 Drawing Sheets

U.S. PATENT DOCUMENTS

| | | | | | |
|---|---|---|---|---|---|
| 4,119,267 | A | | 10/1978 | Kydonieus | 229/53 |
| 4,120,716 | A | | 10/1978 | Bonet | 156/272 |
| 4,136,205 | A | | 1/1979 | Quattlebaum | 426/412 |
| 4,239,111 | A | * | 12/1980 | Conant et al. | 426/124 |
| 4,267,960 | A | | 5/1981 | Lind et al. | 229/55 |
| 4,278,738 | A | | 7/1981 | Brax et al. | 428/515 |
| 4,285,998 | A | | 8/1981 | Thibodeau | 428/35 |
| 4,450,028 | A | | 5/1984 | Vilutis | 156/198 |
| 4,452,835 | A | | 6/1984 | Vasudevan | 428/35 |
| 4,457,960 | A | | 7/1984 | Newsome | 428/35 |
| 4,534,984 | A | | 8/1985 | Kuehne | 426/412 |
| 4,539,236 | A | * | 9/1985 | Vilutis | 383/116 |
| 4,617,241 | A | | 10/1986 | Mueller | 428/520 |
| 4,629,064 | A | | 12/1986 | Barner | 206/204 |
| 4,662,521 | A | | 5/1987 | Moretti | 206/484.2 |
| 4,724,185 | A | | 2/1988 | Shah | 428/339 |
| 4,755,403 | A | | 7/1988 | Ferguson | 428/35 |
| 4,765,857 | A | | 8/1988 | Ferguson | 156/229 |
| 4,801,486 | A | * | 1/1989 | Quacquarella et al. | 426/127 |
| 4,815,590 | A | | 3/1989 | Peppiatt et al. | 206/204 |
| 4,879,430 | A | | 11/1989 | Hoffman | 428/35.1 |
| 4,890,936 | A | * | 1/1990 | Cooper | 383/116 |
| 5,020,922 | A | | 6/1991 | Schirmer | 383/119 |
| 5,206,075 | A | | 4/1993 | Hodgson, Jr. | 428/216 |
| 5,236,728 | A | | 8/1993 | Locke et al. | 426/307 |
| 5,241,031 | A | | 8/1993 | Mehta | 526/348.1 |
| 5,256,428 | A | | 10/1993 | Lustig et al. | 426/127 |
| 5,272,236 | A | | 12/1993 | Lai et al. | 526/348.5 |
| 5,278,272 | A | | 1/1994 | Lai et al. | 526/348.5 |
| 5,302,402 | A | | 4/1994 | Dudenhoeffer et al. | 426/129 |

* cited by examiner

PATCH BAG HAVING OVERHANGING BONDED PATCHES

This application is a continuation of U.S. Ser. No. 08/742,172, filed Nov. 4, 1996, now abandoned, which is a continuation of U.S. Ser. No. 08/268,087, filed Jun. 28, 1994, now abandoned.

FIELD OF THE INVENTION

The present invention relates packages for the packaging of bone-in meat products. More particularly, the present invention relates to a bag having a protective patch adhered directly thereto, the protective patch preventing, or reducing the likelihood, of a bone puncturing completely through the bag and patch thereover.

BACKGROUND OF THE INVENTION

Heat-shrinkable thermoplastics are known to be useful as flexible packaging materials for vacuum packaging various foodstuffs, including meat. Such plastic materials, however, while generally suitable for packaging meat, understandably have difficulties in successfully packaging sharp or bony products. For example, attempts to package bone-in primal cuts of meat usually result in an unsatisfactorily large number of bag failures due to bone punctures. The use of cushioning materials such as paper, paper laminates, wax impregnated cloth, and various types of plastic inserts have proved to be less than totally satisfactory in solving the problem. The preparation of special cuts of meat or close bone trim with removal of protruding bones has also been attempted. However, this is at best only a limited solution to the problem since it does not offer the positive protection necessary for a wide variety of commercial bone-in types of meat. Furthermore, removal of the bone is a relatively expensive and time-consuming procedure.

The use of heat-shrinkable bags having one or two patches adhered thereto has recently become a commercially-preferred manner of packaging bone-in meat product. However, even the bags having two patches thereon leave "uncovered regions" which are more vulnerable to bone puncture because they do not have a patch adhered thereover.

It has been found that in the packaging of certain bone-in meat products, for example with a patch bag containing a pair of bone-in pork loins, the bones puncture the bag at its one or more "uncovered regions", i.e., regions of the bag which are not covered by the patch, also herein referred to as "bald regions". An undesirable level of bone punctures occur even when these uncovered regions have an unshrunken-width of only about 1 inch wide on a bag having an unshrunken, lay-flat width of from about 13 to 17 inches, i.e., a portion of a patch-bag which is about 92% to 94% covered with the patch.

Reorientation of the patch 90° relative to the bottom seam of the bag, this reorientation relocating the uncovered regions relative to the bone-in pork loins within the bag, failed to cure the problem of an undesirable level of bone punctures through the uncovered region, due to the fact that the bone-in pork loins have many different points at which exposed bone ends contact the inside surface of the bag. Reorientation 45° relative to the bottom of the bag also failed to cure the problem, as bones from at least two different regions resulted in an undesirable level of bone punctures in the relocated uncovered regions.

Providing a much-oversized bag can be used to reduce the number of punctures, as the pork loins can be placed in the center of the bag so that the uncovered regions are present on "dog-ears" emanating from the package. However, this solution to the problem is not entirely satisfactory, for several reasons. First, there is the inefficiency of wasted package due to the excessive bag size required to keep the uncovered areas away from the bone-in pork loins. Second, the dog-ears running the length of the package provide an aesthetically less-attractive package. Third, the loins must be carefully placed in the center of the bag, to avoid bone contact with the uncovered areas. Fourth, the meat has the potential to slide around inside the oversized bag, resulting in the potential for the bone to contact uncovered regions, thus increasing the potential for package failure.

It would be desirable to have a patch bag in which the patches leave substantially less total uncovered region, or even substantially no uncovered regions, in order to reduce or eliminate the number of bone punctures.

However, making a patch bag in which the patch extends to the lay flat edge of the bag, or even past the lay-flat edge of the bag, requires that the patch be aligned with the bag. Patch misalignment on the bag can result from patch-lateral mis-alignment, patch-longitudinal misalignment, and patch-skewing. Failure to accurately align the patches with the bag results in exposed glue surfaces which produce difficulties in laminating, bagmaking, and material handling. More particularly, the exposed glue surfaces result in transfer of adhesive to processing rolls, and pickup of dirt and contaminants by the exposed glue, resulting in a requirement of more careful handling. Furthermore, the exposed glue has the potential to cause the wound-up product to adhere to itself. The exposed glue also presents a potential for product contamination. The problems associated with exposed glue surfaces are exacerbated by the fact that the tubing from which the bag is formed has variations in its width, requiring that the patches be of a size to ensure that the entire width of the bag is covered by the patches.

SUMMARY OF THE INVENTION

The present invention provides a patch bag in which patches are adhered to both the bag as well as to one another, to provide puncture-resistance throughout a region extending around substantially the entirety of the patch bag. The patch bag of the present invention can reduce the number of punctures at uncovered regions, especially for the packaging of bone-in meat products such as bone-in pork loins.

As a first aspect, the present invention pertains to a patch bag, comprising a bag having a patch adhered thereto, the patch having a first-patch-overhang-region and a second-patch-overhang-region, wherein at least a portion of the first-patch-overhang-region is adhered to the second-patch-overhang-region. Preferably, the first-patch-overhang-region is present on a first patch, and the second-patch-overhang-region is present on a second patch.

As a second aspect, the present invention pertains to a patch bag comprising a patch film adhered to a bag film, wherein: (a) the patch bag comprises at least two seals made through both the patch film and the bag film; (b) the patch film has a thickness of from about 2 to 8 mils, preferably 3 to 5 mils, the patch film comprising ethylene/alpha-olefin copolymer having a density of from about 0.85 to 0.95; and (c) the bag film has a thickness of from about 1.5 to 5 mils (preferably, about 2.5 mils), comprising an $O_2$ barrier layer (preferably comprising at least one member selected from the group consisting of ethylene/vinyl alcohol copolymer, and a composition comprising polyvinylidene chloride wherein the copolymer comprises at least one member selected from the group consisting of methyl acrylate and vinyl chloride) and another layer comprising ethylene/alpha-olefin copolymer having a density of from about 0.85 to 0.95.

Preferably, the patch film comprises at least one member selected from the group consisting of LLDPE, HDPE, VLDPE, ULDPE, homogeneous ethylene/alpha-olefin copolymer, and EVA; more preferably, ethylene/alpha-olefin copolymer having a density of from about 0.91 to 0.93; still more preferably, a composition comprising a blend of 85 to 100 weight percent LLDPE and 0–15 weight percent ethylene/vinyl acetate copolymer, having a vinyl acetate content of about 9 percent.

Preferably, the bag film comprises at least one member selected from the group consisting of LLDPE, HDPE, VLDPE, ULDPE, homogeneous ethylene/alpha-olefin copolymer, EVA, and ethylene/butyl acrylate copolymer ("EBA"); more preferably, ethylene/alpha-olefin copolymer having a density of from about 0.91 to 0.93; still more preferably, a composition comprising a blend of 85 to 100 weight percent LLDPE and 0–15 weight percent ethylene/vinyl acetate copolymer, having a vinyl acetate content of about 9 percent.

As a third aspect, the present invention pertains to a packaged product, comprising: (a) a package comprising a patch bag having a patch adhered thereto, the patch having a first-patch-overhang-region and a second-patch-overhang-region, wherein at least a portion of the first-patch-overhang-region is adhered to the second-patch-overhang-region; and (b) a meat product in the package, the meat product comprising bone. Preferably, the first-patch-overhang region is present on a first patch, and the second-patch overhang region is present on a second patch.

The manufacture of patch bags having patches overhanging the bag is not completely free of the above-described problems associated with patch bags having the patch extending to the edge of the bag. More particularly, since overhanging patches are preferably applied one at a time, with adhesive applied to the entirety of that side of the patch which is to be adhered to the tubing later to be sealed and cut to form the bag, one side of the overhanging region of the patch has exposed adhesive thereon, the exposed adhesive building up on rolls, conveyors, etc., upstream of the laminating site. Furthermore, since the tubing having one overhanging patch is rolled up and run through the process again for the application of the second patch on the other side of the lay-flat tubing, courses of the rolled up tubing, having patches adhered to one side thereof, have an opportunity to adhere to themselves, i.e., different courses of this rolled-up "intermediate product" have the potential to adhere to one another, as a result of the exposed adhesive on the overhanging patch regions.

Furthermore, the exposed adhesive on the first patches thereafter builds up on rolls downstream of the laminating site, and exposed adhesive due to any misalignment of the two patches can build up on equipment downstream of the laminating site, as well as making bags adhere to one another after the cutting and stacking, packaging, etc., thereof, resulting in greater difficulty of product handling.

The exposed adhesive can also cause roll wraparounds, requiring temporary shutdown of the processing equipment to remove the wraparound, and rethreading of the roll. The exposed adhesive can also cause "small patch foldovers"

However, it has been found that the above problems associated with the manufacture of the overhanging-patch bag (i.e., a "full-width patch bag") of the present invention can be adequately addressed by: (1) carefully selecting rolls of tubing having a lay-flat width narrow enough to ensure full patch coverage and overhang(s); (2) carefully monitoring patch skewing to ensure that an acceptably low level of skewing is present in the intermediate and final products; (3) increasing the frequency of cleaning of the laminator rolls and bagmaking rolls, to prevent excessive accumulation of adhesive which can cause product contamination; (4) careful handling of tubing rolls to prevent contamination of exposed glue surfaces; (5) careful monitoring of bags being produced, to ensure that small patch foldovers are not present, and removal of any products having such a defect; and (6) ensuring that the storage time of laminated rolls does not extend for so long that an unacceptable level of dirt accumulates on the exposed adhesive surfaces.

DETAILED DESCRIPTION OF THE INVENTION

Figure 1:
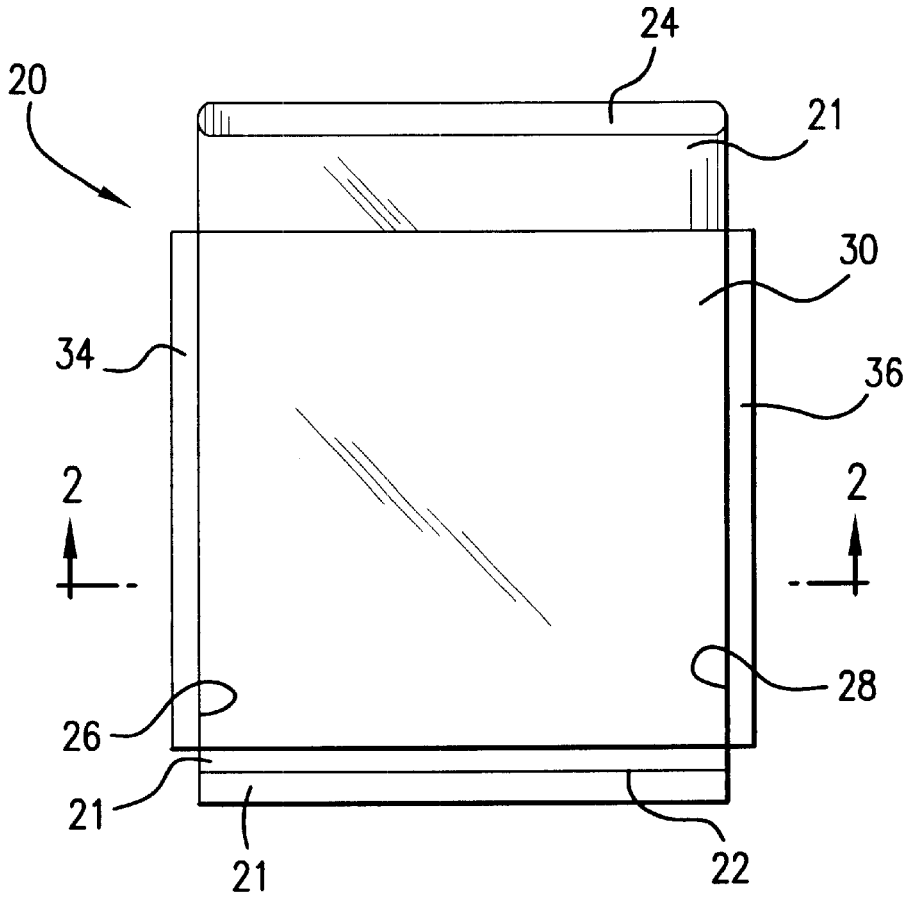
FIG. 1 illustrates a schematic of a preferred end-seal patch bag according to the present invention, in a lay-flat view.

As used herein, the term "film" is used in a generic sense to include plastic web, regardless of whether it is film or sheet. Preferably, films of and used in the present invention have a thickness of 0.25 mm or less. As used herein, the term "package" refers to packaging materials used in the packaging of a product.

As used herein, the phrase "patch overhang region", or "overhang", refers to that portion of a patch which extends beyond: (a) a side edge of the bag to which the patch is adhered, or (b) a bottom edge of the bag to which the patch is adhered, when the bag is in a lay-flat configuration, i.e., when the factory seal(s) is (are) flat against a surface on which the bag has been placed.

The "factory seal" includes any and all seals necessary to convert a bag tubing or film into a bag having an open top. Such seals are made at the bag-making factory, and hence are herein termed to be "factory seals".

The bag "edge", or "sideline", or "bottomline", beyond which the patch overhangs, is usually formed by a mere "fold" in the bag. Although the bag need not have a crease at its edges, in reality the side edges of end seal bags are creased, as is the bottom edge of side-seal bags. However, the edge, sideline, or bottomline also includes bag side and bottom edges which are relatively small regions (e.g., 0.05 inches to either side of the "line") extending from a seal through both the patch and the underlying bag. Bag edges, sidelines, and bottomlines are determined by placing an empty bag on a flat supporting surface, with the factory seals flat against the supporting surface. The perimeter of the bag in its lay flat configuration determines the edges, sidelines, and bottomline.

As used herein, the phrases "seal layer", "sealing layer", "heat seal layer", and "sealant layer", refer to an outer film layer, or layers, involved in the sealing of the film to itself, another film layer of the same or another film, and/or another article which is not a film. It should also be recognized that in general, up to the outer 3 mils of a film can be involved in the sealing of the film to itself or another layer. With respect to packages having only fin-type seals, as opposed to lap-type seals, the phrase "sealant layer" generally refers to the inside film layer of a package, as well as supporting layers adjacent this sealant layer often being sealed to itself, and frequently serving as a food contact layer in the packaging of foods. In general, a sealant layer sealed by heat-sealing layer comprises any thermoplastic polymer; preferably, the heat-sealing layer comprises, for example, thermoplastic polyolefin, thermoplastic polyamide, thermoplastic polyester, and thermoplastic polyvinyl chloride; more preferably, thermoplastic polyolefin; still more preferably, thermoplastic polyolefin having less than 60 weight percent crystallinity.

As used herein, the term "seal" refers to any seal of a first region of a film surface to a second region of a film surface, wherein the seal is formed by heating the regions to at least their respective seal initiation temperatures. The heating can be performed by any one or more of a wide variety of manners, such as using a heated bar, hot air, infrared radiation, ultrasonic sealing, etc.

As used herein, the term "barrier", and the phrase "barrier layer", as applied to films and/or film layers, is used with reference to the ability of a film or film layer to serve as a barrier to one or more gases. Oxygen (i.e., $O_2$) barrier layers can comprise, for example, ethylene/vinyl alcohol copolymer, polyvinyl chloride, polyvinylidene chloride, polyamide, polyester, polyacrylonitrile, etc., as known to those of skill in the art; preferably, the oxygen barrier layer comprises ethylene/vinyl alcohol copolymer, polyvinyl chloride, polyvinylidene chloride, and polyamide; more preferably, ethylene/vinyl alcohol copolymer.

As used herein, the phrase "abuse layer", as well as the phrase "puncture-resistant layer", refer to an outer film layer and/or an inner film layer, so long as the film layer serves to resist abrasion, puncture, and other potential causes of reduction of package integrity, as well as potential causes of reduction of package appearance quality. Abuse layers can comprise any polymer, so long as the polymer contributes to achieving an integrity goal and/or an appearance goal; preferably, abuse layers comprise polymer comprising at least one member selected from the group consisting of ethylene/alpha-olefin copolymer having a density of from about 0.85 to 0.95, polyamide, ethylene/propylene copolymer; more preferably, ethylene/alpha-olefin copolymer having a density of from about 0.91 to 0.93; still more preferably, a composition comprising 85–100 weight percent LLDPE and 0–15 weight percent ethylene/vinyl acetate copolymer, having a vinyl acetate content of about 9 percent.

As used herein, the term "core", and the phrase "core layer", as applied to multilayer films, refer to any internal film layer which has a primary function other than serving as an adhesive or compatibilizer for adhering two layers to one another. Usually, the core layer or layers provide the multilayer film with a desired level of strength, i.e., modulus, and/or optics, and/or added abuse resistance, and/or specific impermeability.

As used herein, the phrase "skin layer" refers to an outside layer of a multilayer film in packaging a product, this skin layer being subject to abuse. Accordingly, the preferred polymers for the skin layer are the same as the preferred polymers for the abuse layer.

As used herein, the phrase "tie layer" refers to any internal layer having the primary purpose of adhering two layers to one another. Tie layers can comprise any nonpolymer polymer having a polar group grafted thereon, so that the polymer is capable of covalent bonding to polar polymers such as polyamide and ethylene/vinyl alcohol copolymer; preferably, tie layers comprise at least one member selected from the group consisting of polyolefin, modified polyolefin, ethylene/vinyl acetate copolymer, modified ethylene/vinyl acetate copolymer, and homogeneous ethylene/alpha-olefin copolymer; more preferably, tie layers comprise at least one member selected from the group consisting of anhydride modified grafted linear low density polyethylene, anhydride grafted low density polyethylene, homogeneous ethylene/alpha-olefin copolymer, and anhydride grafted ethylene/vinyl acetate copolymer.

As used herein, the phrase "bulk layer" refers to any layer of a film which is present for the purpose of increasing the abuse-resistance, toughness, modulus, etc., of a multilayer film. Bulk layers generally comprise polymers which are inexpensive relative to other polymers in the film which provide some specific purpose unrelated to abuse-resistance, modulus, etc. Preferably, bulk layers comprise polyolefin; more preferably, at least one member selected from the group consisting of ethylene/alpha-olefin copolymer, ethylene/alpha-olefin copolymer plastomer, low density polyethylene, and linear low density polyethylene.

As used herein, the phrase "meat-contact layer", refers to a layer of a multilayer film which is in direct contact with the meat-containing product packaged in the film. The meat-contact layer is an outer layer, in order to be in direct contact with the meat product. The meat-contact layer is an inside layer in the sense that in the packaged meat product, the meat-contact layer is the innermost film layer in direct contact with the food.

As used herein, the phrase "meat-contact surface" refers to a surface of a meat-contact layer which is in direct contact with the meat in the package.

As used herein, "EVOH" refers to ethylene vinyl alcohol copolymer. EVOH includes saponified or hydrolyzed ethylene vinyl acetate copolymers, and refers to a vinyl alcohol copolymer having an ethylene comonomer, and prepared by, for example, hydrolysis of vinyl acetate copolymers, or by chemical reactions with polyvinyl alcohol. The degree of hydrolysis is preferably at least 50% and more preferably at least 85%.

As used herein, the term "lamination", the term "laminate", and the phrase "laminated film", refer to the process, and resulting product, made by bonding together two or more layers of film or other materials. Lamination can be accomplished by joining layers with adhesives, joining with heat and pressure, and even spread coating and extrusion coating. The term laminate is also inclusive of coextruded multilayer films comprising one or more tie layers.

As used herein, the term "oriented" refers to a polymer-containing material which has been stretched at an elevated temperature (the orientation temperature), followed by being "set" in the stretched configuration by cooling the material while substantially retaining the stretched dimensions. Upon subsequently heating unrestrained, unannealed, oriented polymer-containing material to its orientation temperature, heat shrinkage is produced almost to the original unstretched, i.e., pre-oriented dimensions. More particularly, the term "oriented", as used herein, refers to oriented films, wherein the orientation can be produced in one or more of a variety of manners.

As used herein, the phrase "orientation ratio" refers to the multiplication product of the extent to which the plastic film material is expanded in several directions, usually two directions perpendicular to one another. Expansion in the machine direction is herein referred to as "drawing", whereas expansion in the transverse direction is herein referred to as "stretching". For films extruded through an annular die, stretching is obtained by "blowing" the film to produce a bubble. The degree of orientation is also referred to as the orientation ratio, or sometimes as the "racking ratio".

As used herein, the term "monomer" refers to a relatively simple compound, usually containing carbon and of low molecular weight, which can react to form a polymer by combining with itself or with other similar molecules or compounds.

As used herein, the term "comonomer" refers to a monomer which is copolymerized with at least one different monomer in a copolymerization reaction, the result of which is copolymer.

As used herein, the term "polymer" refers to the product of a polymerization reaction, and is inclusive of homopolymers, copolymers, terpolymers, etc. In general, the layers of a film can consist essentially of a single polymer, or can have still additional polymers together therewith, i.e., blended therewith.

As used herein, the term "homopolymer" is used with reference to a polymer resulting from the polymerization of a single monomer, i.e., a polymer consisting essentially of a single type of repeating unit.

As used herein, the term "copolymer" refers to polymers formed by the polymerization reaction of at least two different monomers. For example, the term "copolymer" includes the copolymerization reaction product of ethylene and an alpha-olefin, such as 1-hexene. However, the term "copolymer" is also inclusive of, for example, the copolymerization of a mixture of ethylene, propylene, 1-hexene, and 1-octene.

As used herein, the term "polymerization" is inclusive of homopolymerizations, copolymerizations, terpolymerizations, etc., and includes all types of copolymerizations such as random, graft, block, etc. In general, the polymers, in the films used in accordance with the present invention, can be prepared in accordance with any suitable polymerization process, including slurry polymerization, gas phase polymerization, and high pressure polymerization processes.

Slurry polymerization processes generally use superatmospheric pressures and temperatures in the range of 40°–100° C. In a slurry polymerization, a suspension of solid, particulate polymer is formed in a liquid polymerization medium to which ethylene and comonomers and often hydrogen along with catalyst are added. The liquid employed in the polymerization medium can be an alkane, cycloalkane, or an aromatic hydrocarbon such as toluene, ethylbenzene or xylene. The medium employed should be liquid under the conditions of polymerization, and relatively inert. Preferably, hexane or toluene is employed.

Alternatively, gas-phase polymerization process utilizes superatmospheric pressure and temperature in the range of about 50°–120° C. Gas phase polymerization can be preformed in a stirred or fluidized bed of catalyst and product particles in a pressure vessel adapted to permit the separation of product particles from unreacted gases. Ethylene, comonomer, hydrogen and an inert diluent gas such as nitrogen can be introduced or recirculated so as to maintain the particles at temperatures of 50°–120° C. Triethylaluminum may be added as needed as a scavenger of water, oxygen, and other impurities. Polymer product can be withdrawn continuously or semicontinuously, at a rate such as to maintain a constant product inventory in the reactor. After polymerization and deactivation of the catalyst, the product polymer can be recovered by any suitable means. In commercial practice, the polymer product can be recovered directly from the gas phase reactor, freed of residual monomer with a nitrogen purge, and used without further deactivation or catalyst removal.

High pressure polymerization processes utilize a catalyst system comprising a cyclopentadienyl-transition metal compound and an alumoxane compound. It is important, in the high-pressure process, that the polymerization temperature be above about 120° C., but below the decomposition temperature of the polymer product. It is also important that the polymerization pressure be above about 500 bar (kg/$cm^2$). In those situations wherein the molecular weight of the polymer product that would be produced at a given set of operating conditions is higher than desired, any of the techniques known in the art for control of molecular weight, such as the use of hydrogen or reactor temperature, may be used in the process of this invention.

As used herein, the term "copolymerization" refers to the simultaneous polymerization of two or more monomers.

As used herein, a copolymer identified in terms of a plurality of monomers, e.g., "propylene/ethylene copolymer", refers to a copolymer in which either monomer copolymerizes in a higher weight or molar percent. However, the first listed monomer preferably is polymerizes in a higher weight percent than the second listed monomer, and, for copolymers which are terpolymers, quadripolymers, etc., preferably, the first monomer copolymerizes in a higher weight percent than the second monomer, and the second monomer copolymerizes in a higher weight percent than the third monomer, etc.

As used herein, copolymers are identified, i.e., named, in terms of the monomers from which the copolymers are produced. For example, the phrase "propylene/ethylene copolymer" refers to a copolymer produced by the copolymerization of both propylene and ethylene, with or without additional comonomer(s). A copolymer comprises recurring "polymerization units" derived from the monomers from which the copolymer is produced.

As used herein, the phrase "polymerization unit" refers to a unit of a polymer, as derived from a monomer used in the polymerization reaction. For example, the phrase "alpha-olefin polymerization units" refers to a unit in, for example, an ethylene/alpha-olefin copolymer, the polymerization unit being that residue which is derived from the alpha-olefin monomer after it reacts to become a portion of the polymer chain.

Either of the named monomers may copolymerize in a higher weight or molar percent. However, the first listed monomer preferably polymerizes in a higher weight percent than the second listed monomer, and, for copolymers which are terpolymers, quadripolymers, etc., preferably the monomer specified first in the name, i.e., the first-specified monomer, copolymerized in a higher weight percent than the second-specified monomer, and in turn the second-specified monomer copolymerizes in a higher weight percent than the third-specified monomer, etc.

As used herein, terminology employing a "/" with respect to the chemical identity of a copolymer (e.g., "an ethylene/alpha-olefin copolymer"), identifies the comonomers which are copolymerized to produce the copolymer. Such phrases as "ethylene alpha-olefin copolymer" is the respective equivalent of "ethylene/alpha-olefin copolymer."

As used herein, the phrase "heterogeneous polymer" refers to polymerization reaction products of relatively wide variation in molecular weight and relatively wide variation in composition distribution, i.e., polymers made, for example, using conventional Ziegler-Natta catalysts. Heterogeneous polymers are useful in various layers of the film used in the present invention. Such polymers typically contain a relatively wide variety of chain lengths and comonomer percentages.

As used herein, the phrase "heterogeneous catalyst" refers to a catalyst suitable for use in the polymerization of heterogeneous polymers, as defined above. Heterogeneous catalysts are comprised of several kinds of active sites which differ in Lewis acidity and steric environment. Ziegler-Natta catalysts are heterogeneous catalysts. Examples of Ziegler-Natta heterogeneous systems include metal halides activated by an organometallic co-catalyst, such as titanium chloride, optionally containing magnesium chloride, complexed to trialkyl aluminum and may be found in patents such as U.S. Pat. No. 4,302,565, to GOEKE, et. al., and U.S. Pat. No. 4,302,566, to KAROL, et. al., both of which are hereby incorporated, in their entireties, by reference thereto.

As used herein, the phrase "homogeneous polymer" refers to polymerization reaction products of relatively narrow molecular weight distribution and relatively narrow composition distribution. Homogeneous polymers are useful in various layers of the multilayer film used in the present invention. Homogeneous polymers exhibit a relatively even sequencing of comonomers within a chain, the mirroring of sequence distribution in all chains, and the similarity of length of all chains, and are typically prepared using metallocene, or other single-site type catalysis.

More particularly, homogeneous ethylene/alpha-olefin copolymers may be characterized by one or more methods known to those of skill in the art, such as molecular weight distribution ($M_w/M_n$), composition distribution breadth index (CDBI), and narrow melting point range and single melt point behavior. The molecular weight distribution ($M_w/M_n$), also known as polydispersity, may be determined by gel permeation chromatography. The homogeneous ethylene/alpha-olefin copolymers useful in this invention will have a ($M_w/M_n$) of less than 2.7. Preferably, the ($M_w/M_n$) will have a range of about 1.9 to 2.5. More preferably, the ($M_w/M_n$) will have a range of about 1.9 to 2.3. The composition distribution breadth index (CDBI) of such homogeneous ethylene/alpha-olefin copolymers will generally be greater than about 70 percent. The CDBI is defined as the weight percent of the copolymer molecules having a comonomer content within 50 percent (i.e., plus or minus 50%) of the median total molar comonomer content. The CDBI of linear polyethylene, which does not contain a comonomer, is defined to be 100%. The Composition Distribution Breadth Index (CDBI) is determined via the technique of Temperature Rising Elution Fractionation (TREF). CDBI determination clearly distinguishes the homogeneous copolymers used in the present invention (narrow composition distribution as assessed by CDBI values generally above 70%) from VLDPEs available commercially which generally have a broad composition distribution as assessed by CDBI values generally less than 55%. The CDBI of a copolymer is readily calculated from data obtained from techniques known in the art, such as, for example, temperature rising elution fractionation as described, for example, in Wild et. al., *J. Poly. Sci. Poly. Phys. Ed.,* Vol. 20, p.441 (1982). Preferably, the homogeneous ethylene/alpha-olefin copolymers have a CDBI greater than about 70%, i.e., a CDBI of from about 70% to 99%. In general, the homogeneous ethylene/alpha-olefin copolymers in the multilayer films of the present invention also exhibit a relatively narrow melting point range, in comparison with "heterogeneous copolymers", i.e., polymers having a CDBI of less than 55%. Preferably, the homogeneous ethylene/alpha-olefin copolymers exhibit an essentially singular melting point characteristic, with a peak melting point ($T_m$), as determined by Differential Scanning Colorimetry (DSC), of from about 60° C. to 110° C. Preferably the homogeneous copolymer has a DSC peak $T_m$ of from about 80° C. to 100° C. As used herein, the phrase "essentially single melting point" means that at least about 80%, by weight, of the material corresponds to a single $T_m$ peak at a temperature within the range of from about 60° C. to 110° C., and essentially no substantial fraction of the material has a peak melting point in excess of about 115° C., as determined by DSC analysis. DSC measurements are made on a Perkin Elmer System 7 Thermal Analysis System. Melting information reported are second melting data, i.e., the sample is heated at a programmed rate of 10° C./min. to a temperature below its critical range. The sample is then reheated (2nd melting) at a programmed rate of 10° C./min. The presence of higher melting peaks is detrimental to film properties such as haze, and compromises the chances for meaningful reduction in the seal initiation temperature of the final film.

A homogeneous ethylene/alpha-olefin copolymer can, in general, be prepared by the copolymerization of ethylene and any one or more alpha-olefin. Preferably, the alpha-olefin is a $C_3$–$C_{20}$ alpha-monoolefin, more preferably, a $C_4$–$C_{12}$ alpha-monoolefin, still more preferably, a $C_4$–$C_8$ alpha-monoolefin. Still more preferably, the alpha-olefin comprises at least one member selected from the group consisting of butene-1, hexene-1, and octene-1, i.e., 1-butene, 1-hexene, and 1-octene, respectively. Most preferably, the alpha-olefin comprises octene-1, and/or a blend of hexene-1 and butene-1.

Processes for preparing and using homogeneous polymers are disclosed in U.S. Pat. No. 5,206,075, U.S. Pat. No. 5,241,031, and PCT International Application WO 93/03093, each of which is hereby incorporated by reference thereto, in its entirety. Further details regarding the production and use of homogeneous ethylene/alpha-olefin copolymers are disclosed in U.S. PCT International Publication Number WO 90/03414, in the name of Exxon Chemical Patents, Inc., which is also hereby incorporated by reference thereto, in its entirety.

Still another genus of homogeneous ethylene/alpha-olefin copolymers is disclosed in U.S. Pat. No. 5,272,236, to LAI, et. al., and U.S. Pat. No. 5,278,272, to LAI, et. al., both of which are hereby incorporated in their entireties, by reference thereto.

As used herein, the phrase "homogeneous catalyst" refers to a catalyst suitable for use in the polymerization of homogeneous polymers, as defined above. Homogeneous catalysts are also referred to as "single site catalysts", due to the fact that such catalysts typically have only one type of catalytic site, which is believed to be the basis for the homogeneity of the polymers they catalyze the polymerization of.

As used herein, the term "polyolefin" refers to any polymerized olefin, which can be linear, branched, cyclic, aliphatic, aromatic, substituted, or unsubstituted. More specifically, included in the term polyolefin are homopolymers of olefin, copolymers of olefin, copolymers of an olefin and an non-olefinic comonomer copolymerizable with the olefin, such as vinyl monomers, modified polymers thereof, and the like. Specific examples include polypropylene homopolymers, polyethylene homopolymers, poly-butene, propylene/alpha-olefin copolymers, ethylene/alpha-olefin copolymers, butene/alpha-olefin copolymers, ethylene/vinyl acetate copolymers, ethylene/ethyl acrylate copolymers, ethylene/butyl acrylate copolymers, ethylene/methyl acrylate copolymers, ethylene/acrylic acid copolymers, ethylene/methacrylic acid copolymers, modified polyolefin resins, ionomer resins, polymethylpentene, etc. The modified polyolefin resins include modified polymers prepared by copolymerizing the homopolymer of the olefin or copolymer thereof with an unsaturated carboxylic acid, e.g., maleic acid, fumaric acid or the like, or a derivative thereof such as the anhydride, ester or metal salt or the like. It could also be obtained by incorporating into the olefin homopolymer or copolymer, an unsaturated carboxylic acid, e.g., maleic acid, fumaric acid or the like, or a derivative thereof such as the anhydride, ester or metal salt or the like.

As used herein, terms identifying polymers, such as "polyamide", "polyester", "polyurethane", etc. are inclusive of not only polymers comprising repeating units derived from monomers known to polymerize to form a polymer of the named type, but are also inclusive of comonomers, derivatives, etc. which can copolymerize with monomers known to polymerize to produce the named polymer. For example, the term "polyamide" encompasses both polymers comprising repeating units derived from monomers, such as caprolactam, which polymerize to form a polyamide, as well as copolymers derived from the copolymerization of caprolactam with a comonomer which when polymerized alone does not result in the formation of a polyamide. Furthermore, terms identifying polymers are also inclusive of mixtures, blends, etc. of such polymers with other polymers of a different type.

As used herein, the phrase "modified polymer", as well as more specific phrases such as "modified ethylene vinyl acetate copolymer", and "modified polyolefin" refer to such polymers having an anhydride functionality, as defined immediately above, grafted thereon and/or copolymerized therewith and/or blended therewith. Preferably, such modified polymers have the anhydride functionality grafted on or polymerized therewith, as opposed to merely blended therewith.

As used herein, the phrase "anhydride-containing polymer" and "anhydride-modified polymer", refers to one or more of the following: (1) polymers obtained by copolymerizing an anhydride-containing monomer with a second, different monomer, and (2) anhydride grafted copolymers, and (3) a mixture of a polymer and an anhydride-containing compound.

As used herein, the phrase "ethylene alpha-olefin copolymer", and "ethylene/alpha-olefin copolymer", refer to such heterogeneous materials as linear low density polyethylene (LLDPE), and very low and ultra low density polyethylene (VLDPE and ULDPE); and homogeneous polymers such as metallocene catalyzed polymers such as EXACT (TM) materials supplied by Exxon, and TAFMER (TM) materials supplied by Mitsui Petrochemical Corporation. These materials generally include copolymers of ethylene with one or more comonomers selected from $C_4$ to $C_{10}$ alpha-olefin such as butene-1 (i.e., 1-butene), hexene-1, octene-1, etc. in which the molecules of the copolymers comprise long chains with relatively few side chain branches or cross-linked structures. This molecular structure is to be contrasted with conventional low or medium density polyethylenes which are more highly branched than their respective counterparts. LLDPE, as used herein, has a density usually in the range of from about 0.91 grams per cubic centimeter to about 0.94 grams per cubic centimeter. Other ethylene/alpha-olefin copolymers, such as the long chain branched homogeneous ethylene/alpha-olefin copolymers available from the Dow Chemical Company, known as AFFINITY (TM) resins, are also included as another type of ethylene alpha-olefin copolymer useful in the present invention.

In general, the ethylene/alpha-olefin copolymer comprises a copolymer resulting from the copolymerization of from about 80 to 99 weight percent ethylene and from 1 to 20 weight percent alpha-olefin. Preferably, the ethylene alpha-olefin copolymer comprises a copolymer resulting from the copolymerization of from about 85 to 95 weight percent ethylene and from 5 to 15 weight percent alpha-olefin.

As used herein, the phrases "inner layer" and "internal layer" refer to any layer, of a multilayer film, having both of its principal surfaces directly adhered to another layer of the film.

As used herein, the phrase "outer layer" refers to any film layer of film having less than two of its principal surfaces directly adhered to another layer of the film. The phrase is inclusive of monolayer and multilayer films. In multilayer films, there are two outer layers, each of which has a principal surface adhered to only one other layer of the multilayer film. In monolayer films, there is only one layer, which, of course, is an outer layer in that neither of its two principal surfaces are adhered to another layer of the film.

As used herein, the phrase "inside layer" refers to the outer layer, of a multilayer film packaging a product, which is closest to the product, relative to the other layers of the multilayer film.

As used herein, the phrase "outside layer" refers to the outer layer, of a multilayer film packaging a product, which is furthest from the product relative to the other layers of the multilayer film.

As used herein, the term "adhered" is inclusive of films which are directly adhered to one another using a heat seal or other means, as well as films which are adhered to one another using an adhesive which is between the two films.

As used herein, the phrase "directly adhered", as applied to film layers, is defined as adhesion of the subject film layer to the object film layer, without a tie layer, adhesive, or other layer therebetween. In contrast, as used herein, the word "between", as applied to a film layer expressed as being between two other specified layers, includes both direct adherence of the subject layer between to the two other layers it is between, as well as including a lack of direct adherence to either or both of the two other layers the subject layer is between, i.e., one or more additional layers can be imposed between the subject layer and one or more of the layers the subject layer is between.

As used herein, the term "extrusion" is used with reference to the process of forming continuous shapes by forcing a molten plastic material through a die, followed by cooling or chemical hardening. Immediately prior to extrusion through the die, the relatively high-viscosity polymeric material is fed into a rotating screw of variable pitch, which forces it through the die.

As used herein, the term "coextrusion" refers to the process of extruding two or more materials through a single die with two or more orifices arranged so that the extrudates merge and weld together into a laminar structure before chilling, i.e., quenching. Coextrusion can be employed in film blowing, free film extrusion, and extrusion coating processes.

As used herein, the phrase "machine direction", herein abbreviated "MD", refers to a direction "along the length" of the film, i.e., in the direction of the film as the film is formed during extrusion and/or coating.

As used herein, the phrase "transverse direction", herein abbreviated "TD", refers to a direction across the film, perpendicular to the machine or longitudinal direction.

As used herein, the phrase "free shrink" refers to the percent dimensional change in a 10 cm×10 cm specimen of film, when subjected to selected heat, as measured by ASTM D 2732, as known to those of skill in the art.

Although the majority of the above definitions are substantially as understood by those of skill in the art, one or more of the above definitions may be defined hereinabove in a manner differing from the meaning as ordinarily understood by those of skill in the art, due to the particular description herein of the present invention.

Although the films used in the patch bag according to the present invention can be monolayer films or multilayer films, the patch bag comprises at least two films laminated together. Preferably, the patch bag is comprised of films which together comprise a total of from 2 to 20 layers; more preferably, from 2 to 12 layers; and still more preferably, from 4 to 9 layers.

In general, the multilayer film(s) used in the present invention can have any total thickness desired, so long as the film provides the desired properties for the particular packaging operation in which the film is used, e.g. abuse-resistance (especially puncture-resistance), modulus, seal strength, optics, etc.

Figure 2:
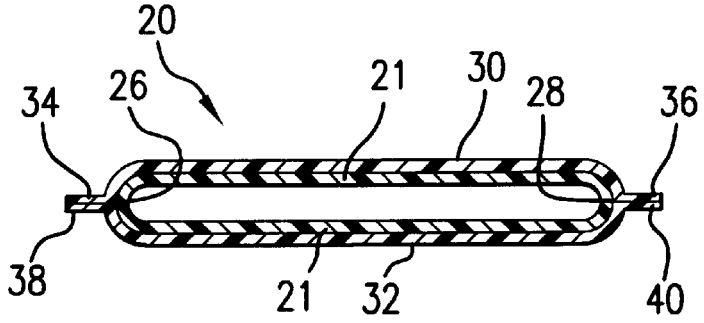
FIG. 2 illustrates a cross-sectional view of the end-seal patch bag illustrated in FIG. 1, taken through section 2—2 of FIG. 1.

FIG. 1 is a side-view illustration of a preferred patch bag 20 substantially in its lay-flat configuration, this patch bag being in accord with the present invention. FIG. 2 is a cross-sectional view of patch bag 20 taken through section 2—2 of FIG. 1.

Viewing both FIGS. 1 and 2, patch bag 20 comprises bag 21 having end-seal 22, open top 24, first side edge 26, and second side-edge 28. Adhered to the outside surface of bag 21 are first patch 30 and second patch 32. First patch 30 has first overhang 34, which overhangs first side edge 26, and second overhang 36, which overhangs second side edge 28. Second patch 32 has third overhang 38, which overhangs first side edge 26 and is adhered to first overhang 34, and fourth overhang 40 which overhangs second side edge 28 and is adhered to second overhang 36. Thus, over the length of bag 21 on which first patch 30 and second patch 32 are adhered, the full width of bag 21 is "covered" by the combination of patches 30 and 32, i.e., together, patches 30 and 32 constitute a "full width" coverage of bag 21. The two end portions of bag 20 are not covered by patches 30 and 32 in order that strong end seals can be made through bag 21, without having to seal through both of patches 30 and/or 32, which would be weaker than sealing through only bag 21.

Although not illustrated, two additional features can be utilized in the patch bag according to the present invention. The first feature, of particular advantage in the end-seal patch bag illustrated in FIGS. 1 and 2, is a supplemental end-seal across the bag, this supplemental end-seal being parallel to the bottom seal but above, i.e., inward of, the bottom seal, i.e., preferably a supplemental bottom seal produced by sealing through both patches as well as sealing through the bag, although the supplemental seal can be through the bag only, at a location within, for example, one-eighth of an inch from the bottom edge of the patches. The supplemental seal can be continuous across the bag, or can be a series of intermittent "tack welds". In either event, the purpose of the supplemental seal is to prevent the primary seal from being subjected to pressure by the product within the bag, and to protect the bottom end of the product by ensuring that substantially the entirety of the bottom of the product is covered by the patches. This particular features is discussed in detail in copending U.S. patent application Ser. No. 278,367, now U.S. Pat. No. 5,545,419, to BRADY et. al., entitled "PATCH BAG HAVING SUPPLEMENTAL SEAL". Of course, the feature is useful regardless of whether the patch is overhanging.

The second additional feature, also not illustrated herein, is an end-seal patch bag resulting from the process of applying a "continuous patch" to a first side of the lay-flat bag tubing, while applying a set of separate patches to the second side of the lay-flat bag tubing. Thereafter, the end-seal is made by directly contacting the bag film with the sealing apparatus at "uncovered" regions of the second side of the lay flat tubing. In this manner, at least half of the bottom region of the patch bag can be covered with a patch, while avoiding the need to seal through the patch. This particular feature is discussed in detail in copending U.S. patent application Ser. No. 08/579,712, to OBERLE et. al., entitled "PATCH BAG HAVING CONTINUOUS PATCH". Of course, this feature is useful regardless of whether the patch is overhang.

Preferably, the film stock film from which the patches are cut has a total thickness of from about 2 to 8 mils; more preferably, from about 3 to 5 mils.

Figure 3:
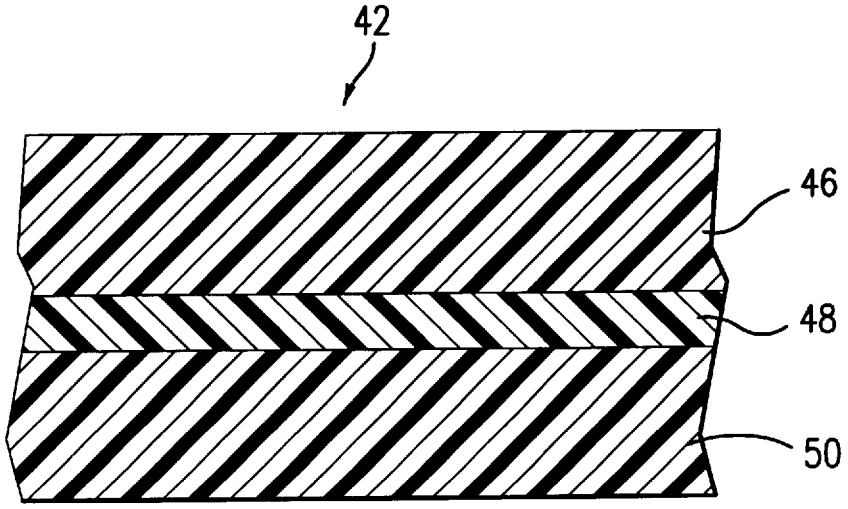
FIG. 3 illustrates a cross-sectional view of a preferred multilayer film suitable for use as the patch in the patch-bag according to FIG. 1.

FIG. 3 illustrates a cross-sectional view of preferred multilayer film 42 for use as the stock material from which patches 30 and 32 are formed. Multilayer film 42 has a physical structure, in terms of number of layers, layer thickness, and layer arrangement and orientation in the patch bag, and a chemical composition in terms of the various polymers, etc. present in each of the layers, as set forth in Table I, below.

TABLE I

| layer designation | layer function | chemical identity | layer thickness (mils) |
|---|---|---|---|
| 46 | outside layer & puncture-resistant layer | 87% LLDPE #1; 10% EVA #1; 3% antiblock masterbatch #1 | 2.0 |
| 48 | tie layer | EVA #2 | 0.7 |
| 50 | inside layer & puncture-resistant layer | 87% LLDPE #1; 10% EVA #1; 3% antiblock masterbatch #1 | 2.0 |

LLDPE #1 was DOWLEX 2045 (TM) linear low density polyethylene, obtained from the Dow Chemical Company of Midland, Mich. EVA #1 was ELVAX 3128 (TM) ethylene/vinyl acetate copolymer having a 9% vinyl acetate content, obtained from E. I. DuPont de Nemours, of Wilmington, Del. EVA #2 was ELVAX 3175 GC (TM) ethylene/vinyl acetate copolymer having a 28% vinyl acetate content, obtained from E. I. DuPont de Nemours, of Wilmington, Del. Antiblock masterbatch #1 was used in either of two different grades. The first grade, a clear masterbatch, was a masterbatch known as 10,075 ACP SYLOID CONCENTRATE (TM) obtained from Technor Apex Co. of Pautucket, R.I. The second grade, a creme colored masterbatch, was a masterbatch known as EPC 9621C CREAM COLOR SYLOID CONCENTRATE (TM), also obtained from Technor Apex Co. of Pautucket, R.I. The primary difference between these two masterbatches is that of color, which is both aesthetic, and potentially functional in that photosensor alignment means for accurate registration of the patches on the bags can utilize the coloration in the patch for detection of the location of the patch.

Figure 4:
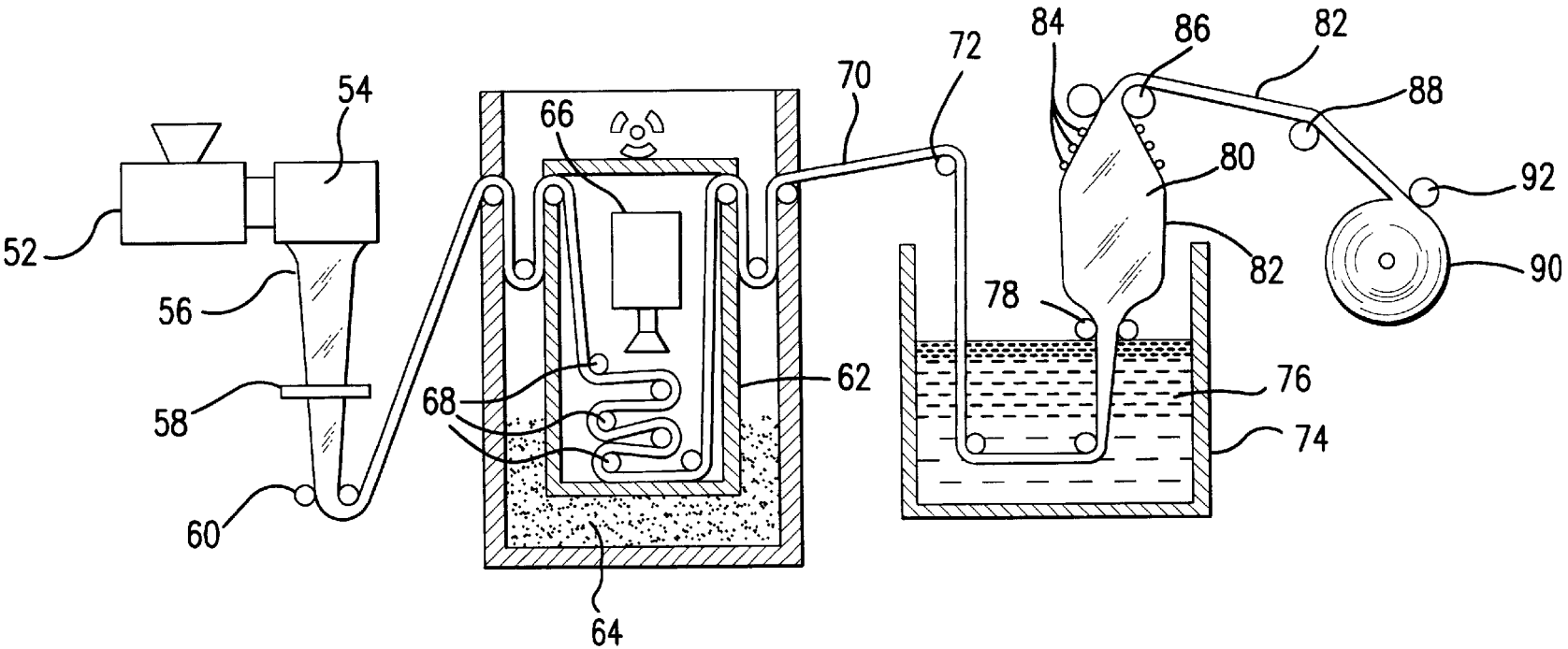
FIG. 4 illustrates a schematic view of a preferred process for making the multilayer film of FIG. 3.

FIG. 4 illustrates a schematic of a preferred process for producing the multilayer film of FIG. 3. In the process illustrated in FIG. 4, solid polymer beads (not illustrated) are fed to a plurality of extruders 52 (for simplicity, only one extruder is illustrated). Inside extruders 52, the polymer beads are forwarded, melted, and degassed, following which the resulting bubble-free melt is forwarded into die head 54, and extruded through annular die, resulting in tubing 56 which is 5–40 mils thick, more preferably 20–30 mils thick, still more preferably, about 25 mils thick.

After cooling or quenching by water spray from cooling ring 58, tubing 56 is collapsed by pinch rolls 60, and is thereafter fed through irradiation vault 62 surrounded by shielding 64, where tubing 56 is irradiated with high energy electrons (i.e., ionizing radiation) from iron core transformer accelerator 66. Tubing 56 is guided through irradiation vault 62 on rolls 68. Preferably, the irradiation of tubing 56 is at a level of about 7 MR.

After irradiation, irradiated tubing 70 is directed over guide roll 72, after which irradiated tubing 70 passes into hot water bath tank 74 containing water 76. The now collapsed irradiated tubing 70 is submersed in the hot water for retention time of at least about 5 seconds, i.e., for a time period in order to bring the film up to the desired temperature, following which supplemental heating means (not illustrated) including a plurality of steam rolls around which irradiated tubing is partially wound, and optional hot air blowers, elevate the temperature of irradiated tubing 70 to a desired orientation temperature of from about 240° F.–250° F. Thereafter, irradiated film 70 is directed through nip rolls 78, and bubble 80 is blown, thereby transversely stretching irradiated tubing 70. Furthermore, while being blown, i.e., transversely stretched, nip rolls 86 draw irradiated film 70 in the longitudinal direction, as nip rolls 86 have a higher surface speed than the surface speed of nip rolls 78. As a result of the transverse stretching and longitudinal drawing, irradiated, biaxially-oriented blown tubing film 82 is produced, this blown tubing preferably having been both stretched in a ratio of from about 1:1.5–1:6, and drawn in a ratio of from about 1:1.5–1.6. More preferably, the stretching and drawing are each performed a ratio of from about 1:2–1:4. The result is a biaxial orientation of from about 1:2.25–1:36, more preferably, 1:4–1:16.

While bubble 80 is maintained between pinch rolls 78 and 86, blown tubing 82 is collapsed by rolls 84, and thereafter conveyed through pinch rolls 86 and across guide roll 88, and then covered through pinch rolls 86 and across guide roll 88, and then rolled onto wind-up roll 90. Idler roll 92 assures a good wind-up.

Preferably, the stock film from which the bag is formed has a total thickness of from about 1.5 to 5 mils; more preferably, about 2.5 mils. Preferably the stock film from which the bag is formed is a multilayer film having from 3 to 7 layers; more preferably, 4 layers.

Figure 5:
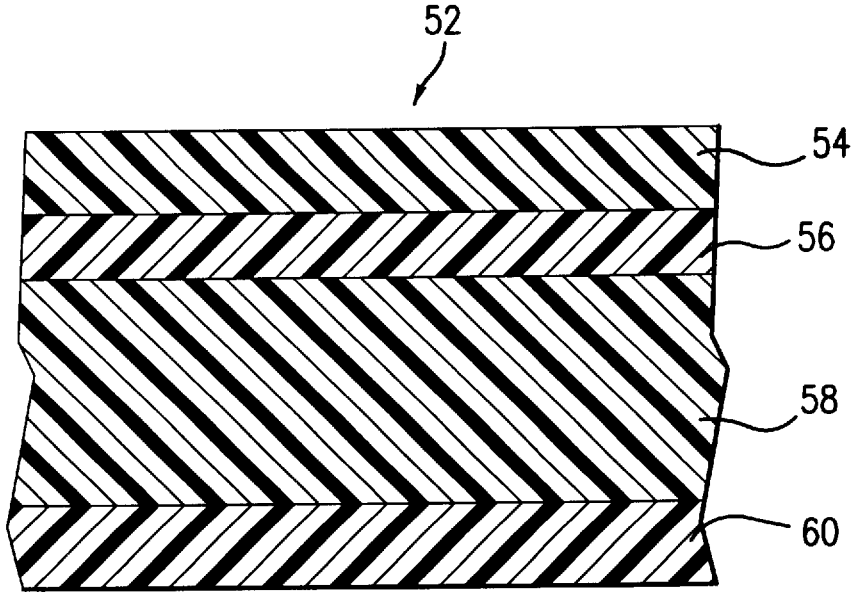
FIG. 5 illustrates a cross-sectional view of a preferred multilayer film suitable for use as the bag in the patch-bag according to FIG. 1.

FIG. 5 illustrates a cross-sectional view of preferred multilayer film 52 for use as the tubing film stock material from which bag 21 is formed. Multilayer film 52 has a physical structure, in terms of number of layers, layer thickness, and layer arrangement and orientation in the patch bag, and a chemical composition in terms of the various polymers, etc. present in each of the layers, as set forth in Table II, below.

TABLE II

| layer designation | layer function | chemical identity | layer thickness (mils) |
|---|---|---|---|
| 54 | outside layer & abuse layer | EVA #1 | 0.56 |
| 56 | barrier layer | 96% VDC/MA #1; 2% epoxidized soybean oil; 2% bu-A/MA/bu-MA terpolymer | 0.2 |
| 58 | puncture-resistant layer | 80% LLDPE #1 20% EBA #1 | 1.25 |
| 60 | sealant layer & inside layer | EVA #1 | 0.33 |

EVA #1 was the same ethylene/vinyl acetate copolymer described above. VDC/MA #1 was SARAN MA-134 (TM) vinylidene chloride/methyl acrylate copolymer, obtained from the Dow Chemical Company. The epoxidized soybean oil was PLAS-CHEK 775 (TM) epoxidized soybean oil, obtained from the Bedford Chemical Division of Ferro Corporation, of Walton Hills, Ohio. Bu—A/Ma/bu—MA terpolymer was METABLEN L-1000 (TM) butyl acrylate/methyl methacrylate/butyl methacrylate terpolymer, obtained from Elf Atochem North America, Inc., of 2000 Market Street, Philadelphia, Pa. 19103. EBA #1 was EA 705-009 (TM) ethylene/butyl acrylate cooplymer containing 5% butyl acrylate, obtained from the Quantum Chemical Company of Cincinnati, Ohio. Alternatively, EBA #1 can be EA 719-009 (TM) ethylene/butyl acrylate copolymer, having a butyl acrylate content of 18.5%, also obtained from Quantum Chemical Company.

Figure 6:
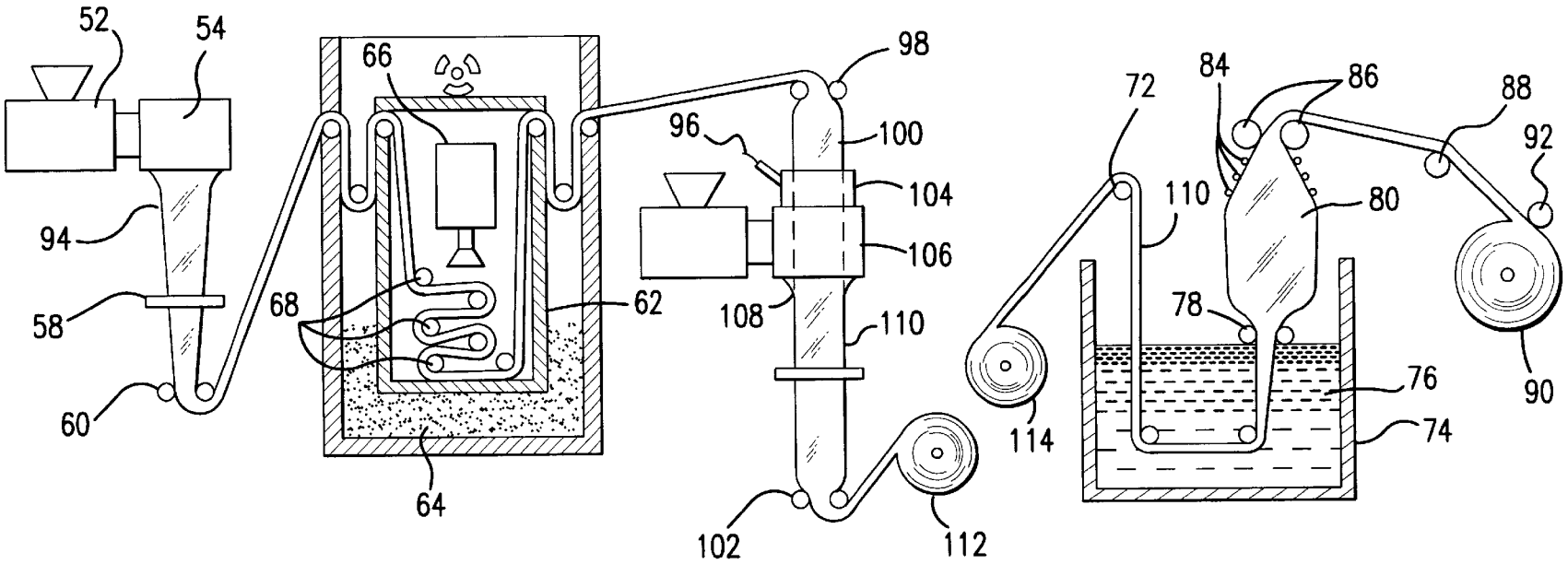
FIG. 6 illustrates a schematic view of a preferred process for making the multilayer film of FIG. 5.

FIG. 6 illustrates a schematic of a preferred process for producing the multilayer film of FIG. 5. In the process illustrated in FIG. 6, solid polymer beads (not illustrated) are fed to a plurality of extruders 52 (for simplicity, only one extruder is illustrated). Inside extruders 52, the polymer beads are forwarded, melted, and degassed, following which the resulting bubble-free melt is forwarded into die head 54, and extruded through annular die, resulting in tubing 94 which is 10–30 mils thick, more preferably 15–25 mils thick.

After cooling or quenching by water spray from cooling ring 58, tubing 94 is collapsed by pinch rolls 60, and is thereafter fed through irradiation vault 62 surrounded by shielding 64, where tubing 94 is irradiated with high energy electrons (i.e., ionizing radiation) form iron core transformer accelerator 66. Tubing 94 is guided through irradiation vault 62 on rolls 68. Preferably, tubing 94 is irradiated to a level of about 4.5 MR.

After irradiation, irradiated tubing 96 is directed through pinch rolls 98, following which tubing 96 is slightly inflated, resulting in trapped bubble 100. However, at trapped bubble 100, the tubing is not significantly drawn longitudinally, as the surface speed of nip rolls 102 are about the same speed as nip rolls 98. Furthermore, irradiated tubing 96 is inflated only enough to provide a substantially circular tubing without significant transverse orientation, i.e., without stretching.

Slightly inflated, irradiated tubing 96 is passed through vacuum chamber 104, and thereafter forwarded through coating die 106. Second tubular film 108 is melt extruded from coating die 106 and coated onto slightly inflated, irradiated tube 96, to form two-ply tubular film 110. Second tubular film 108 preferably comprises an $O_2$ barrier layer, which does not pass through the ionizing radiation. Further details of the above-described coating step are generally as set forth in U.S. Pat. No. 4,278,738, to BRAX et. al., which is hereby incorporated by reference thereto, in its entirety.

After irradiation and coating, two-ply tubing film 110 is wound up onto windup roll 112. Thereafter, windup roll 112 is removed and installed as unwind roll 114, on a second stage in the process of making the tubing film as ultimately desired. Two-ply tubular film 110, from unwind roll 114, is unwound and passed over guide roll 72, after which two-ply tubular film 110 passes into hot water bath tank 74 containing water 76. The now collapsed, irradiated, coated tubular film 110 is submersed in hot water 76 (having a temperature of about 210° F.) for a retention time of at least about 5 seconds, i.e., for a time period in order to bring the film up to the desired temperature for biaxial orientation. Thereafter, irradiated tubular film 110 is directed through nip rolls 78, and bubble 80 is blown, thereby transversely stretching tubular film 110. Furthermore, while being blown, i.e., transversely stretched, nip rolls 86 draw tubular film 110 in the longitudinal direction, as nip rolls 86 have a surface speed higher than the surface speed of nip rolls 78. As a result of the transverse stretching and longitudinal drawing, irradiated, coated biaxially-oriented blown tubing film 82 is produced, this blown tubing preferably having been both stretched in a ratio of from about 1:1.5–1:6, and drawn in a ratio of from about 1:1.5–1:6. More preferably, the stretching and drawing are each performed a ratio of from about 1:2–1:4. The result is a biaxially orientation of from about 1:2.25–1:36, more preferably, 1:4–1:16. While bubble 80 is maintained between pinch tools 78 and 86, blown tubing 82 is collapsed by rolls 84, and thereafter conveyed through pinch rolls 86 and across guide roll 88, and then rolled onto wind-up roll 90. Idler roll 92 assures a good wind-up.

The polymer components used to fabricate multilayer films according to the present invention may also contain appropriate amounts of other additives normally included in such compositions. These include slip agents such as talc, antioxidants, fillers, dyes, pigments and dyes, radiation stabilizers, antistatic agents, supplemental elastomers, and the like additives known to those of skill in the art of packaging films.

The multilayer films used to make the patch bag of the present invention are preferably irradiated to induce crosslinking, as well as corona treated to roughen the surface of the films which are to be adhered to one another. In the irradiation process, the film is subjected to an energetic radiation treatment, such as corona discharge, plasma, flame, ultraviolet, X-ray, gamma ray, beta ray, and high energy electron treatment, which induce cross-linking between molecules of the irradiated material. The irradiation of polymeric films is disclosed in U.S. Pat. No. 4,064,296, to BORNSTEIN, et. al., which is hereby incorporated in its entirety, by reference thereto. BORNSTEIN, et. al. discloses the use of ionizing radiation for crosslinking the polymer present in the film.

To produce crosslinking, a suitable radiation dosage of high energy electrons is in the range of up to about 12 MR, more preferably about 2 to about 9 MR, and still more preferably, about 3 MR. Preferably, irradiation is carried out by an electron accelerator and the dosage level is determined by standard dosimetry methods.

Other accelerators such as a Vander Graff or resonating transformer may be used. The radiation is not limited to electrons from an accelerator since any ionizing radiation may be used. The unit of ionizing radiation generally used is the rad, hereinafter referred to as "RAD", which is defined as the amount of radiation which will result in the absorption of 100 ergs of energy per gram of irradiated material. The megarad, hereinafter referred to as "MR", is one million ($10^6$) RAD. The ionizing radiation crosslinks the polymers in the film. Preferably, the film is irradiated at a level of from 2–15 MR, more preferably 2–10 MR, still more preferably, about 7 MR. As can be seen from the descriptions of preferred films for use in the present invention, the most preferred amount of radiation is dependent upon the film and its end use.

As used herein, the phrases "corona treatment" and "corona discharge treatment" refer to subjecting the surfaces of thermoplastic materials, such as polyolefins, to corona discharge, i.e., the ionization of a gas such as air in close proximity to a film surface, the ionization initiated by a high voltage passed through a nearby electrode, and causing oxidation and other changes to the film surface, such as surface roughness.

Corona treatment of polymeric materials is disclosed in U.S. Pat. No. 4,120,716, to BONET, issued Oct. 17, 1978, herein incorporated in its entirety by reference thereto, discloses improved adherence characteristics of the surface of polyethylene by corona treatment, to oxidize the polyethylene surface. U.S. Pat. No. 4,879,430, to HOFFMAN, also hereby incorporated in its entirety by reference thereto, discloses the use of corona discharge for the treatment of plastic webs for use in meat cook-in packaging, with the corona treatment of the inside surface of the web to increase the adhesion of the meat to the adhesion of the meat to the proteinaceous material.

Although corona treatment is a preferred treatment of the multilayer films used to make patch bag of the present invention, plasma treatment of the film may also be used.

A preferred patch bag of the present invention, as illustrated for example in FIGS. 1 and 2, can be manufactured by a preferred process comprising the steps of: (A) coextruding a first thermoplastic film; (B) orienting the first thermoplastic film in a machine direction and a transverse direction, so that a first biaxially-oriented, heat-shrinkable, thermoplastic film is produced; (C) cutting a first biaxially-oriented, heat-shrinkable thermoplastic patch from the first biaxially-oriented heat-shrinkable, thermoplastic film; (D) coextruding a second thermoplastic film; (E) orienting the second thermoplastic film in the machine direction and the transverse direction, so that a second biaxially-oriented, heat-shrinkable, thermoplastic film is produced; (F) cutting a second biaxially-oriented, heat-shrinkable, thermoplastic patch, from the second biaxially-oriented, heat-shrinkable, thermoplastic film; (G) adhering the first and second biaxially-oriented, heat-shrinkable, thermoplastic patches to a surface of the biaxially-oriented, heat-shrinkable film, preferably in the form of a tubing, in a manner so that the first patch has a first-patch-overhang-region, and the second patch has a second-patch-overhang-region, and at least a portion of said first-patch-overhang-region is adhered to said second-patch-overhang-region; and (H) sealing and cutting the tubing having the first and second patches adhered thereto, so that a patch bag is formed. Preferably, the first patch and the second patch are both cut from one biaxially-oriented, heat-shrinkable, thermoplastic film. Preferably, the one biaxially-oriented, heat-shrinkable, thermoplastic film, from which the first and second patches are cut, comprises a first multilayer film. Preferably, the tubing comprises a second multilayer film.

In this process, if an end-seal patch bag is the desired product, the tubing having the first and second patches adhered thereto is sealed and cut so that an end-seal bag is produced. Preferably, the tubing having the first and second patches adhered thereto is produced by a process comprising the steps of: (A) coextruding a multilayer thermoplastic film tube having an inside film layer and an outside film layer, the inside layer of aid thermoplastic tube comprising a first ethylene vinyl acetate copolymer and the outside layer of said tube also comprising a composition comprising linear low density polyethylene and a second ethylene vinyl acetate copolymer; (B) applying a sufficient amount of a particulate to an interior surface of the film tube, so that upon collapsing, the tube does not self adhere, but so that, upon drawing (as described in detail below), the drawn tubing can be adhered to itself; (C) collapsing the film tube; (D) irradiating the collapsed tube; (E) opening, inflating, heating, drawing, and stretching the tube, so that the tube is biaxially oriented; (F) cooling, collapsing and flattening the biaxially oriented tube so that the inside surface of the tube adheres to itself; (G) cutting the tube to form the first and second biaxially-oriented, heat-shrinkable multilayer patches; and (H) adhering the patch to a surface of the heat-shrinkable thermoplastic bag.

Figure 7:
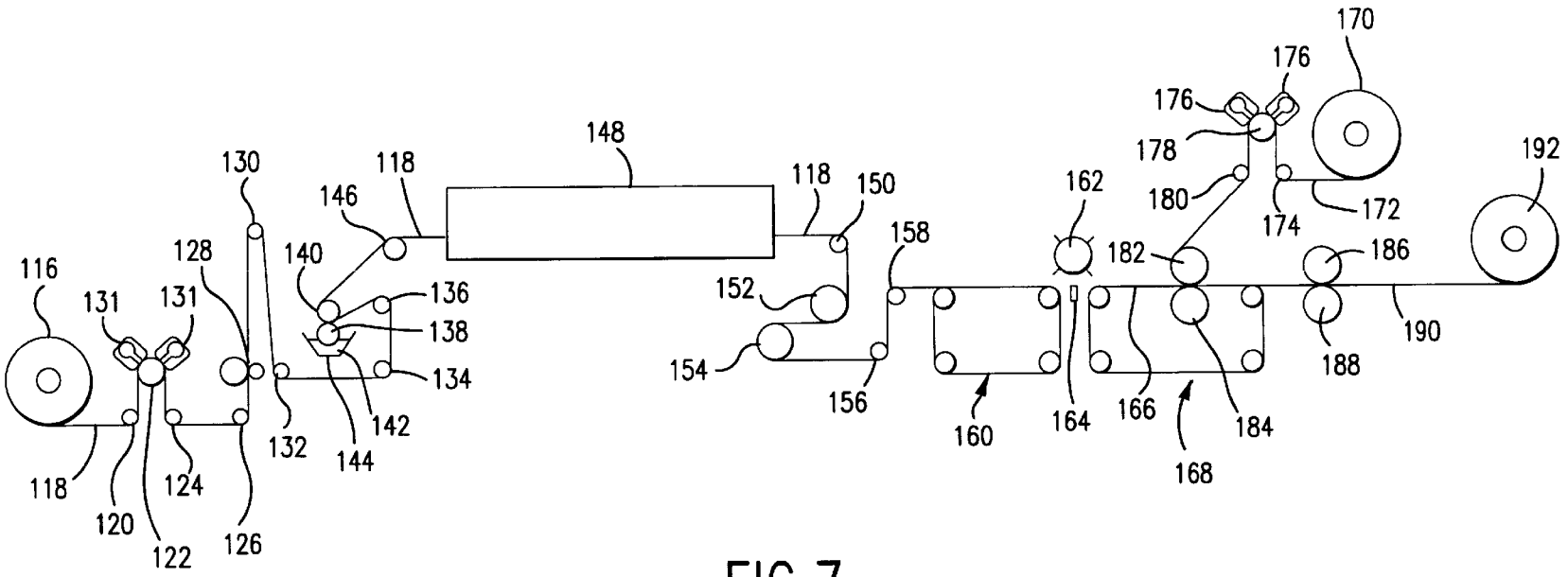
FIG. 7 illustrates a schematic view of a preferred process for making the patch bag of FIG. 1, using the films of FIGS. 3 and 5, as respectively produced by the processes of FIGS. 4 and 6.

FIG. 7 illustrates a schematic representation of a preferred process for manufacturing a patch bag according to the present invention (e.g., a patch bag as illustrated in FIGS. 1 and 2) from the films as illustrated in FIGS. 3 and 5, which are prepared according to processes as illustrated in FIGS. 4 and 6, respectively.

In FIG. 7, patch film roll 116 supplies patch film 118. Patch film 118 is directed, by idler roll 120, to corona treatment devices 131 which subject the upper surface of patch film 118 to corona treatment as patch film 118 passes over corona treatment roll 122. After corona treatment, patch film 118 is directed, by idler rolls 124 and 126, into (optional) printing roll 128.

Patch film 118 is thereafter directed over idler rolls 130, 132, 134, and 136, after which patch film 118 is passed between a small gap (i.e., a gap wide enough to accommodate patch film 118 passing therethrough while receiving an amount of adhesive which corresponds with a dry coating, i.e., weight after drying, of about 45 milligrams per 10 square inches of patch film) between adhesive application roll 138 and adhesive metering roll 140. Adhesive application roll 138 is partially immersed in adhesive 142 supplied to trough 144. As adhesive roll 138 rotates counter-clockwise, adhesive 142, picked up by the immersed surface of adhesive roll 138, moves upward, contacts, and is metered onto, the full width of one side of patch film 118, moving in the same direction as the surface of adhesive roll 138. [Examples of suitable types of adhesives include thermoplastic acrylic emulsions, solvent based adhesive and high solids adhesives, ultraviolet-cured adhesive, and electron-beam cured adhesive, as known to those of skill in the art. The presently preferred adhesive is a thermoplastic acrylic emulsion known as ROHPLEX N619 thermoplastic acrylic emulsion, obtained from the Rohm & Haas Company, at Dominion Plaza Suite 545, 17304 Preston Rd., Dallas, Tex. 75252, Rohm & Haas having headquarters at 7th floor, Independence Mall West, Philadelphia, Pa. 19105.] Patch film 118 thereafter passes so far around adhesive metering roll 140 (rotating clockwise) that the adhesive-coated side of patch film 118 is in an orientation wherein the adhesive is on the top surface of patch film 118, as adhesive-coated patch film 118 moves between adhesive metering roll 140 and idler roll 146.

Thereafter, adhesive-coated patch film 118 is directed over drying oven entrance idler roll 146, and passed through oven 148 within which patch film 118 is dried to a degree that adhesive 142 on patch film 118 becomes tacky. Upon exiting oven 148, patch film 118 is directed partially around oven-exit idler roll 150, following which patch film 118 is cooled on chill rolls 152 and 154, each of which has a surface temperature of about 40–45° F., and a diameter of about 12 inches. The cooling of patch film 118 is carried out in order to stabilize patch film 118 from further shrinkage.

Thereafter, patch film 118 is directed, by idler rolls 156 and 158, by pre-cutting vacuum conveyor assembly 160, and thereafter forwarded to a rotary scissor-type knife having upper rotary blade assembly 162 and lower blade 164, which cuts across the width of patch film 118 in order to form patches 166. Patches 166 are forwarded and held on a belt of post-cutting vacuum conveyor assembly 168. While patches 166 are held on the belt of post-cutting vacuum conveyor assembly 168, tubing-supply roll 170 supplies biaxially oriented, lay-flat film tubing 172, which is directed, by idler roll 174, to corona treatment devices 176 which subject the upper outside surface of lay-flat tubing film 172 to corona treatment as lay-flat tubing film 172 passes over corona treatment roll 178. After corona treatment, lay-flat tubing film 172 is directed, by idler roll 180, partially around the surface of upper pre-lamination nip roll 182, and through the nip between upper prelaminating nip roll 182 and lower prelaminating nip roll 184, the pre-laminating nip rolls being above and below the post-cutting vacuum conveyor belt. Prelaminating nip rolls 182 and 184 position patches 166 onto the now lower, corona-treated outside surface of lay-flat film tubing 172. After passing through the nip between prelaminating nip rolls 182 and 184, lay-flat tubing 172, having patches 166 laminated intermittently thereon, exits off the downstream end of the post-cutting vacuum conveyor assembly 168, and is directed through the nip between upper laminating nip roll 186 and lower laminating nip roll 188, these rolls exerting pressure (about 75 psi) in order to secure patches 166 to lay-flat tubing 172, to result in patch-laminated lay-flat tubing 190. Thereafter, patch-laminated lay-flat tubing 190 is wound up to form rewind roll 192, with rewind roll 192 having the laminated patches thereon oriented towards the outer-facing surface of patch-laminated lay-flat tubing 190.

In a subsequent process not separately illustrated, roll 192 is removed from its winder and is positioned in the place of tubing supply roll 170, and the process of FIG. 7, described immediately above, is repeated, wherein a second set of patches is laminated to patch-laminated lay-flat tubing 192, this second set of patches being applied to the other side of patch-laminated lay-flat tubing 192. Of course, the second set of patches are accurately aligned and registered so that they correspond with the positioning of the first set of patches laminated to lay-flat tubing film 172. In order to achieve accurate alignment, photosensors (i.e., photoeyes, etc.), not illustrated, are used to detect the location of the patch. An appropriate location for such a photosensor is upstream of upper pre-lamination roll 182, below the patch-laminated lay-flat tubing.

Throughout the process described above, patches 166 have a width greater than the width of lay-flat tubing film 172, so that the patches overhang the side edges of lay-flat tubing film 172. The patch overhangs of the first set of patches, i.e, applied to a first side of the lay-flat tubing film 172, are matched up with the patch overhangs of the second set of patches, i.e., applied to the second (uncovered) side of lay-flat tubing film 172.

Once both sets of patches have been applied to lay-flat tubing film 172, the resulting two-patch tubing is directed onto a bag-making machine, in a process not illustrated. A factory seal is formed between patches, the seal being formed about 1 inch downstream of the downstream end of a pair of patches which are adhered together. In this manner, it has been found that a stronger seal is formed than a seal which is made through the patches. Immediately following the formation of the factory seal, the sealed tubing is cut completely across, and completely through both sides of the tubing, at a position about 0.75 inch downstream of the factory seal, to result in a bag as illustrated in FIGS. 1 and 2.

Figure 8:
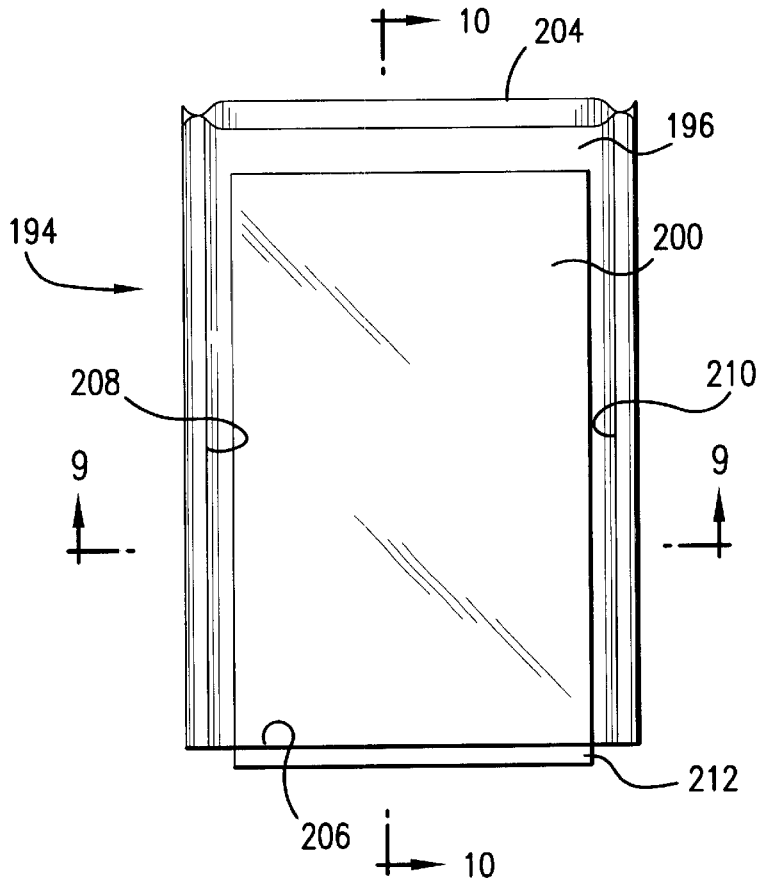
FIG. 8 illustrates a schematic of a side-seal patch bag according to the present invention, in a lay-flat view.
Figure 9:
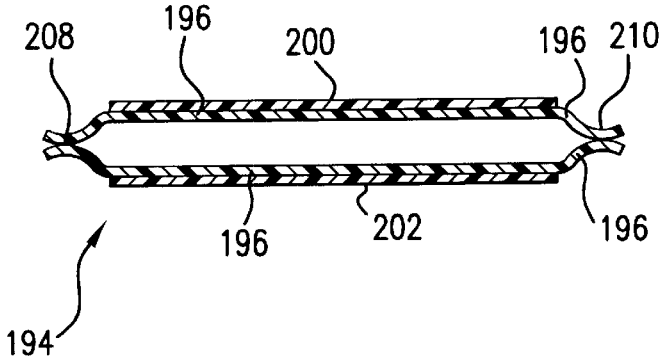
FIG. 9 illustrates a cross-sectional view of the side-seal patch bag illustrated in FIG. 8, taken through section 9—9 of FIG. 8.
Figure 11:
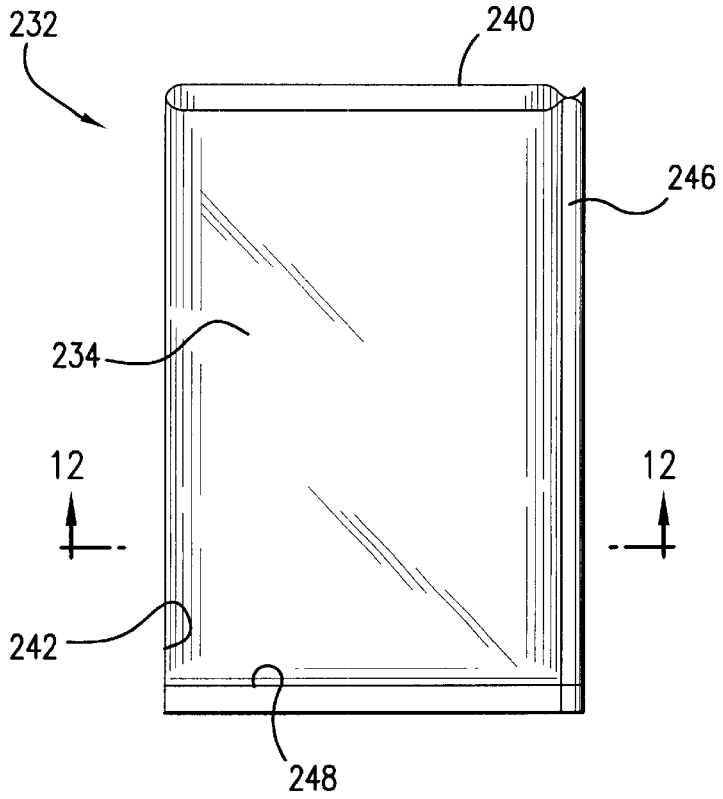
FIG. 11 illustrates a schematic of a laminated film bag according to the present invention, in a lay-flat view.
Figure 10:
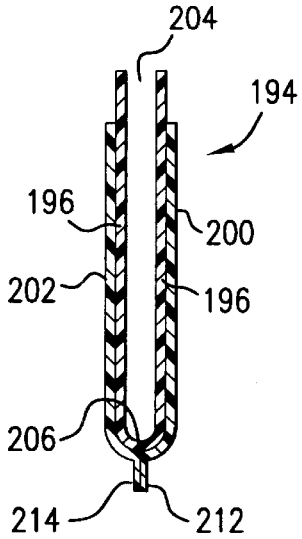
FIG. 10 illustrates a cross-sectional view of the side-seal patch bag illustrated in FIG. 8, taken through section 10—10 of FIG. 8.
Figure 12:
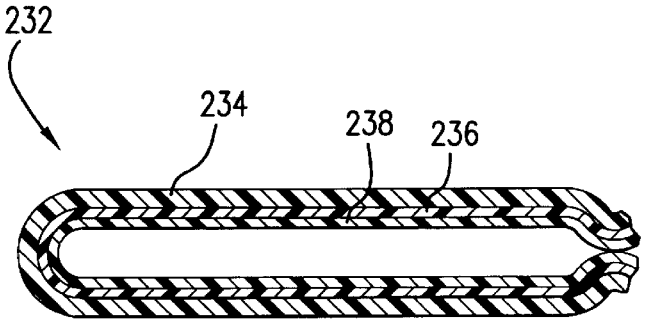
FIG. 12 illustrates a cross-sectional view of the bag illustrated in FIG. 11, taken through section 12—12 of FIG. 11.

As can be readily recognized by those of skill in the art, a process, analogous to the process set forth in FIG. 3, can be set up for making the side seal bag as illustrated in FIGS. 8, 9, and 10, the laminated film bag as illustrated in FIGS. 11 and 12, as well as various other embodiments which can be used to obtain effective full width patch coverage. These alternative embodiments of the bag according to the present invention will now be described in more detail.

The patch bag illustrated in FIGS. 1, 2, 8, 9, 10, 11, and 12 can be prepared in a manner as disclosed in U.S. Pat. No. 3,552,090, U.S. Pat. No. 3,383,746, and U.S. Pat. No. 3,628,576, issued Dec. 21, 1971, to OWEN, each of these two U.S. patents as well as the U.S. patent application, hereby being incorporated by reference thereto, in their entireties. In the event that a continuous laminate of the "bag film" and the "patch film" is converted into a bag by sealing through the entire laminate, e.g. to result in the patch as illustrated in FIGS. 11 and 12, described in detail below, it is believed that such a process results in a patch bag inferior to the bag as illustrated in FIGS. 1 and 2, because seals made through the patch film can result in burn through, as well as weaker seals.

FIGS. 8, 9, 10, 11, and 12 illustrate various views of an alternative patch bags in accord with the present invention.

A "side seal" patch bag in accord with the present invention is illustrated in FIGS. 8, 9, and 10. FIG. 8 illustrates a schematic of side seal patch bag 194, in a lay-flat view. FIG. 9 illustrates a cross-sectional view taken through section 9—9 of FIG. 8. FIG. 10 illustrates a cross-sectional view taken through section 10—10 of FIG. 8.

With reference to FIGS. 8, 9, and 10 together, side seal patch bag 194 is comprised of bag film 196, first patch film 200, and second patch film 202. Patch bag 194 has open top 204, bottom edge 206, first side seal 208, second side seal 210, first patch overhang 212, and second patch overhang 214. Side seal patch bag 196 provides a bottom which has complete patch coverage across all but relatively small regions along the sides of the bag. In this manner, side seals 208 and 210 can be made through the bag film alone, without being made through the patch films, which, as stated above, results in a weaker seal than seals made through the bag film alone.

A "laminated" patch bag 232 in accord with the present invention is illustrated in FIGS. 11 and 12. FIG. 11 illustrates a schematic of laminated patch bag 232 from a lay-flat view. FIG. 12 illustrates a cross-sectional view taken through section 12—12 of FIG. 11.

With reference to FIGS. 11 and 12 together, laminated patch bag 232 is comprised of outside film 234, adhesive layer 236 (illustrated much thicker than is preferred), and inside film 238. Open top 240, first side edge 242, side seal 246, and bottom seal 248. Outer film 234 and inner film 238, are adhered together with an adhesive, for example the acrylic emulsion adhesive described hereinabove. Preferably, outer film 234 is a multilayer film having the physical and chemical characteristics as illustrated in FIG. 3 (as described in detail above). Preferably, inner film 238 is a multilayer film as illustrated in FIG. 5 (as described in detail above).

Although in general the bag according to the present invention can be used in the packaging of any product, the bag of the present invention is especially advantageous for the packaging of food products, especially fresh meat products. Among the meat products which can be packaged in the films and packages according to the present invention are poultry, pork, beef, lamb, goat, horse, and fish. Still more preferably, the bag of the present invention is used in the packaging of a pair of bone-in whole pork loins.

Figure 13:
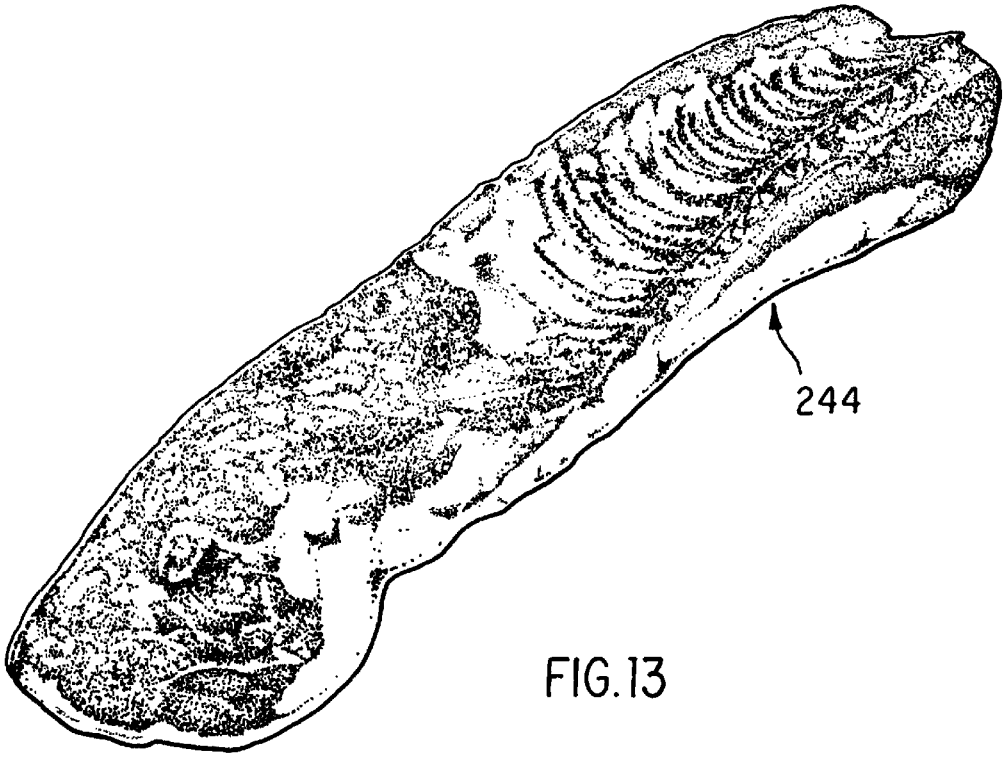
FIG. 13 illustrates a perspective view of a fresh, bone-in whole pork loin, viewed from the ham end.
Figure 14:
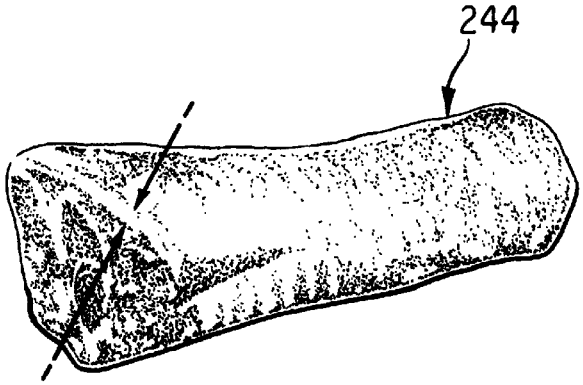
FIG. 14 illustrates a perspective view of fresh, bone-in whole pork loin, viewed from the shoulder end.
Figure 15:
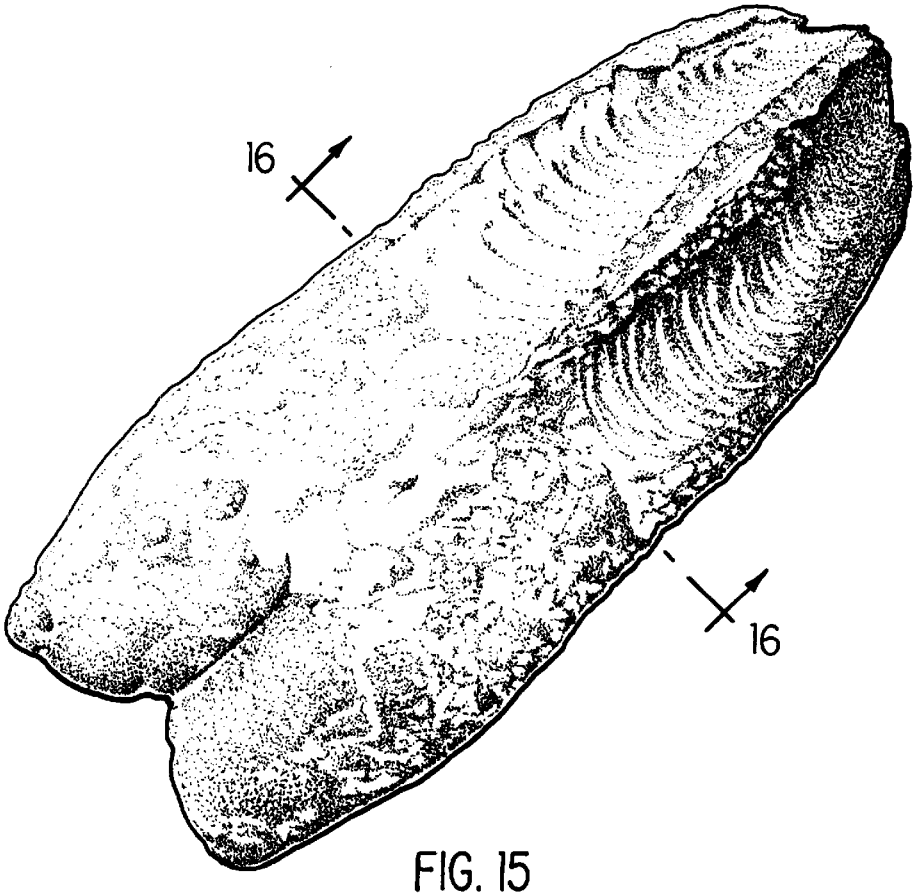
FIG. 15 illustrates a perspective view of a shrunken patch bag containing a pair of fresh, bone-in whole pork loins, each viewed from the ham end.

FIG. 13 illustrates a perspective view of whole bone-in pork loin 244 viewed from the ham end; FIG. 14 illustrates a perspective view of the bone-in whole pork loin 244 viewed from the shoulder end; FIG. 15 illustrates a perspective view of bone-in whole pork loins 244, each viewed from the ham end, aligned together in a preferred position for packaging in a preferred patch bag as set forth illustrated in FIGS. 1 and 2, as described in detail above. The pair of pork loins as illustrated in FIG. 15 are placed in the patch bag as illustrated in FIGS. 1 and 2, with the patch bag thereafter being evacuated, sealed, and shrunken, to result in a packaged product according to the present invention.

Figure 16:
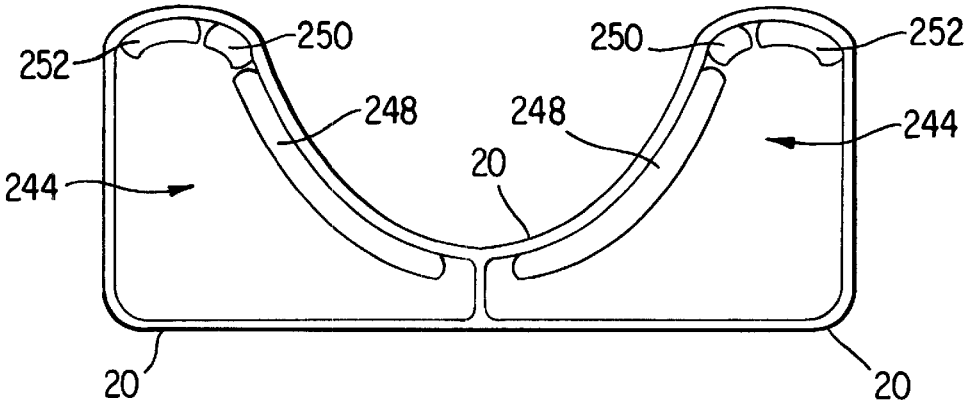
FIG. 16 illustrates a cross-sectional view taken through section 16—16 of FIG. 15, with the addition of a patch bag within which the pair of bone-in pork loins are packaged.

FIG. 16 illustrates a cross-sectional view taken through section 16—16 of FIG. 15, together with the addition of a cross-sectional view of a patch bay 246, which can be, for example, the patch bag illustrated in FIGS. 1 and 2 as described above. Each of pork loins 244 contains rib bone 248, chine bone 250, and feather bone 252. It has been found that using a patch bag in which the patches do not extend to the side edges of the bag, but rather extend only up to about one-half inch from the edge of the bag, allow one or more of rib bones 248, chine bone 250, and feather bone 252 to cause bone punctures. If the patches are rotated 90 degrees, as disclosed in U.S. Pat. No. 5,540,646, to WILLIAMS et. al., issued Jul. 30, 1996, which is hereby incorporated by reference thereto, in its entirety, the problem of puncture is simply transferred from one set of bones to another. If the patches are rotated about 45 degrees, it has been found that at least two of the at least three bones present in the whole pork loin cause bone puncture problems.

Although the present invention has been described in connection with the preferred embodiments, it is to be understood that modifications and variations may be utilized without departing from the principles and scope of the invention, as those skilled in the art will readily understand. Accordingly, such modifications may be practiced within the scope of the following claims.

What is claimed is:

1. A patch bag, comprising a bag having a first patch adhered thereto and a second patch adhered thereto, the first patch having a first-patch-overhang-region and the second patch having a second-patch-overhang-region, wherein at least a portion of said first-patch-overhang-region is adhered to said second-patch-overhang-region, and wherein said patch bag has a seal of a first lay-flat side of the bag to a second lay-flat side of the bag, and said seal is in a region of the bag in which neither an outside surface nor an inside surface of the bag is covered by either the first patch or the second patch.

2. The patch bag according to claim 1, wherein:

the first patch has a first first-patch-overhang-region and a second first-patch-overhang-region;

the second patch has a first second-patch-overhang-region and a second second-patch-overhang-region; and at least a portion of the first first-patch-overhang-region is adhered to at least a portion of the first second-patch-overhang-region, and at least a portion of the second first-patch-overhang-region is adhered to at least a portion of the second second-patch-overhang-region.

3. A patch bag according to claim 2, wherein the first patch and the second patch together extend completely around the bag, and wherein all the first first-patch-overhang-region is adhered to all of the first second-patch-overhang-region; and all of the second first-patch-overhang-region is adhered to all of the second second-patch-overhang-region.

4. The patch bag according to claim 2, wherein the bag comprises a thermoplastic composition, the first patch comprises a thermoplastic composition, and the second patch comprises a thermoplastic composition.

5. The patch bag according to claim 3, wherein the bag is heat-shrinkable, the first patch is heat-shrinkable, and the second patch is heat-shrinkable.

6. The patch bag according to claim 5, wherein the bag comprises a biaxially-oriented film, the first patch comprises a biaxially-oriented film, and the second path comprises a biaxially-oriented film.

7. The patch bag according to claim 6, wherein both the first patch and the second patch are adhered to the outside surface of the bag.

8. The patch bag according to claim 6, wherein the bag comprises a monolayer film.

9. The patch bag according to claim 6, wherein the first patch comprises a first monolayer film and the second patch comprises a second monolayer film.

10. The patch bag according to claim 6, wherein the bag comprises a first multilayer film.

11. The patch bag according to claim 10, wherein the multilayer film comprises an $O_2$ barrier layer.

12. The patch bag according to claim 11, wherein the first patch comprises a second multilayer film, and the second patch comprises a third multilayer film.

13. The patch bag according to claim 12, wherein:

the first multilayer film comprises a first layer, the first layer being an outside abuse layer, a second layer, the second layer being the barrier layer, a third layer, the third layer being a puncture-resistant layer, and a fourth layer, the fourth layer being an inside layer which is a sealant layer;

the second multilayer film comprises a fifth layer which is an outside puncture-resistant layer, a sixth layer which is a tie layer, and a seventh layer which is an inside puncture resistant layer; and the third multilayer film comprises an eighth layer which is an outside puncture-resistant layer, a ninth layer which is a tie layer, and a tenth layer which is an inside puncture resistant layer.

14. The patch bag according to claim 1, wherein:

the bag is a side-seal bag having a seamless bottom, a first side seal, and a second side seal;

the first patch has a first-patch-overhang-region and the second patch has a second-patch-overhang-region, and both the first-patch-overhang-region and the second-patch-overhang-region overhang the seamless bottom of the bag, and are adhered to one another.

15. A packaged product, comprising:

a package comprising a patch bag comprising a bag having a first patch adhered thereto and a second patch adhered thereto, the first patch having a first-patch-overhang-region and the second patch having a second-patch-overhang-region, wherein at least a portion of the first-patch-overhang-region is adhered to the second-patch-overhang-region, and wherein said patch bag has a seal of a first lay-flat side of the bag to a second lay-flat side of the bag, and said seal is in a region of the bag in which neither an outside surface nor an inside surface of the bag is covered by either the first patch or the second patch; and a meat product in the package, the meat product comprising bone.

16. The packaged product according to claim 15, comprising a first patch and a second patch adhered to said bag, wherein the first-patch-overhang-region is present on the first patch, and the second-patch-overhang-region is present on the second patch.

17. The packaged product according to claim 16, wherein the meat product comprises a bone-in meat product comprising at least one member selected from the group consisting of ham, spareribs, picnic, back rib, short loin, short rib, whole turkey, pork loin.

18. The packaged product according to claim 17, wherein the meat product comprises two bone-in pork loins.

19. The patch bag according to claim 1, wherein the bag, the first patch, and the second patch each comprise a thermoplastic film.

20. The patch bag according to claim 5, wherein the patch comprises linear low density polyethylene.

21. The patch bag according to claim 20, wherein the patch further comprises ethylene/vinyl acetate copolymer.

22. The patch bag according to claim 1, wherein:

(A) the patch film has a thickness of from about 2 to 8 mils, the patch film comprising ethylene/alpha-olefin copolymer having a density of from about 0.85 to 0.95; and (B) the bag film has a thickness of form about 1.5 to 5 mils, and comprises an $O_2$- barrier layer and a layer comprising ethylene/alpha-olefin copolymer having a density of from about 0.85 to 0.95.

23. The patch bag according to claim 22, wherein the patch comprises linear low density polyethylene.

24. The patch bag according to claim 23, wherein the patch further comprises ethylene/vinyl acetate copolymer.

* * * * *